US012660925B2

(12) United States Patent
Chen et al.

(10) Patent No.: US 12,660,925 B2
(45) Date of Patent: Jun. 23, 2026

(54) FOLDING CHAIR BRACKET AND FOLDING CHAIR

(71) Applicant: Shenzhen Bosaidong Technology Co., Ltd., Shenzhen (CN)

(72) Inventors: Shangjin Chen, Shenzhen (CN); Tianshi Cui, Shenzhen (CN)

(73) Assignee: Shenzhen Bosaidong Technology Co., Ltd., Shenzhen (CN)

( * ) Notice: Subject to any disclaimer, the term of this patent is extended or adjusted under 35 U.S.C. 154(b) by 158 days.

(21) Appl. No.: 18/593,973

(22) Filed: Mar. 3, 2024

(65) Prior Publication Data

US 2025/0151910 A1 May 15, 2025

(30) Foreign Application Priority Data

Nov. 14, 2023 (CN) ..... 202311523202.X
Nov. 14, 2023 (CN) ..... 202311523235.4
Nov. 14, 2023 (CN) ..... 202323075767.4

(51) Int. Cl.
*A47C 4/28* (2006.01)
*A47C 4/30* (2006.01)

(52) U.S. Cl.
CPC ..... *A47C 4/286* (2013.01); *A47C 4/30* (2013.01)

(58) Field of Classification Search
CPC ..... A47C 4/286; A47C 9/10
See application file for complete search history.

(56) References Cited

U.S. PATENT DOCUMENTS 4,359,244 A * 11/1982 Koehm ..... A47C 5/10 297/16.2
11,122,904 B2 * 9/2021 Zhang ..... A47C 4/022
11,166,558 B2 * 11/2021 Leach ..... A47C 4/02
11,805,912 B2 * 11/2023 Zhu ..... A47C 4/02
12,004,657 B2 * 6/2024 Jin ..... A47C 4/286
2017/0311723 A1 * 11/2017 Lenhart ..... A47C 4/42
2020/0329875 A1 * 10/2020 Zhang ..... A47C 4/18
2021/0196048 A1 * 7/2021 Leach ..... A47C 4/286
2023/0037907 A1 * 2/2023 Zhu ..... A47C 4/28
2024/0090669 A1 * 3/2024 Jin ..... A47C 4/286
2025/0331642 A1 * 10/2025 Zhu ..... A47C 4/286

FOREIGN PATENT DOCUMENTS

CN 222091208 U * 12/2024 ..... A47C 4/28

* cited by examiner

*Primary Examiner* — Philip J Bonzell

(57) ABSTRACT

Disclosed is a folding chair bracket, including a rear supporting seat, a left connecting rod, a right connecting rod, a left front supporting seat, a right front supporting seat, a front connecting rod, a plurality of supporting legs and a plurality of supporting rods, and a folding locking assembly; one side of the right front supporting seat opposite to the left front supporting seat is provided with a connecting recess for accommodating the front connecting rod; and the folding locking assembly is arranged on the right front supporting seat and has a locked state and an unlocked state, where in the locked state, the folding locking assembly may lock and fix a right end of the front connecting rod into the connecting recess, and in the unlocked state, the front connecting rod may be removed from the connecting recess. The present disclosure further discloses a folding chair.

7 Claims, 22 Drawing Sheets

FOLDING CHAIR BRACKET AND FOLDING CHAIR

CROSS REFERENCES TO RELATED APPLICATION

This application claims priorities of Chinese Patent Application Nos. 202323075767.4, 202311523202.X and 202311523235.4 filed on Nov. 14, 2023, the entire contents of which are hereby incorporated by reference.

TECHNICAL FIELD

The present disclosure relates to the technical field of outdoor equipment, in particular to a folding chair bracket and a folding chair.

BACKGROUND

Folding chairs are widely popular in outdoor activities such as camping, beach leisure and sports events because of their characteristics of lightweight and portability. Traditional folding chairs often use a quadrilateral structure as a main support structure, connecting various components through spring ropes and controlling the folding and unfolding of the folding chairs under an elastic action. However, the quadrilateral structure has poor stability and is unstable during use, causing safety hazards.

In order to solve the above problems, the utility model with an authorized notification number CN218127667U discloses a novel automatic folding chair, its folding chair bracket includes an automatic folding assembly, a rear supporting seat and two front supporting seats which are symmetrically arranged left and right, a telescopic rod in the automatic folding assembly is an elastic rod which may extend axially under the action of an external action force or an own internal force, and retracts axially under the own internal force or the external action force, a self-locking piece is arranged on the telescopic rod, in a locked state, the self-locking piece may limit telescoping of the telescopic rod, and in an unlocked state, the telescopic rod may actively extend and retract to store and fold the folding chair.

In the above novel automatic folding chair, a triangular structure is formed by the rear supporting seat and the two front supporting seats, which has good stability. However, in order to be foldable, the telescopic rod and an adapter are added, the structure is relatively complex, and folding and unfolding operations are relatively complex. The self-locking piece is arranged on an upper side of the telescopic rod, when people sit, if the weight is too large, it is prone to accidentally touching the self-locking piece on the upper side for unlocking, causing safety hazards.

SUMMARY

A technical problem to be solved by the present disclosure is to provide a folding chair bracket with a simple structure, convenient use and safety.

Another technical problem to be solved by the present disclosure is to provide a folding chair with a simple structure, convenient use and safety.

In order to solve the above technical problems, according to one aspect of the present disclosure, a folding chair bracket is provided, and includes:

a rear supporting seat;

a left connecting rod, with a rear end hinged with the rear supporting seat to be capable of rotating in a horizontal direction;

a right connecting rod, with a rear end hinged with the rear supporting seat to be capable of rotating in the horizontal direction;

a left front supporting seat, connected to a front end of the left connecting rod;

a right front supporting seat, connected to a front end of the right connecting rod, one side of the right front supporting seat opposite to the left front supporting seat being provided with a connecting recess;

a front connecting rod, with a left end hinged to the left front supporting seat to be capable of rotating in the horizontal direction;

a folding locking assembly, arranged on the right front supporting seat and having a locked state and an unlocked state, where in the locked state, the folding locking assembly may lock and fix a right end of the front connecting rod into the connecting recess of the right front supporting seat, and in the unlocked state, the front connecting rod may be removed from the connecting recess;

a plurality of supporting legs, correspondingly and detachably inserted to the rear supporting seat, the left front supporting seat and the right front supporting seat from bottoms; and a plurality of supporting rods, correspondingly and detachably inserted to the rear supporting seat, the left front supporting seat and the right front supporting seat from tops.

In order to solve the above technical problems, according to another aspect of the present disclosure, a folding chair is provided, and includes one above folding chair bracket and a flexible seat surface connected with an upper part of the folding chair bracket, where a plurality of connection sleeves are arranged on the flexible seat surface, and the connection sleeves are arranged on supporting rods in a sleeving mode.

The present disclosure has the beneficial technical effects that: compared with the prior art, the rear supporting seat, and the left front supporting seat and the right front supporting seat which are located on one side of the rear supporting seat in the present disclosure are matched through the left connecting rod, the right connecting rod and the front connecting rod to form a triangular structure, and supporting is stable. The left end of the front connecting rod is hinged with the left front supporting seat, and the folding locking assembly used for locking the right end of the front connecting rod on the right front supporting seat or unlocking it from the right front supporting seat is arranged on the right front supporting seat. That is, in the present disclosure, when in the locked state, the folding locking assembly may lock and fix one end of the front connecting rod located in the connecting recess of the right front supporting seat, so that the folding chair bracket is in an unfolded state. When in the unlocked state, the front connecting rod may be removed from the connecting recess to achieve folding. It can be learned that according to the folding chair bracket of the present disclosure, during use, the front connecting rod may be locked and fixed through the folding locking assembly to achieve unfolding of the folding chair bracket, and unlocking of the front connecting rod may further be achieved through the folding locking assembly to achieve folding and storage of the folding chair bracket. The structure is simple, and the operation is convenient. The folding locking assembly is located on the right front supporting seat, so that it is not prone to being accidentally touched during use, which avoids safety hazards of sudden folding of the folding chair caused by accidental touch.

DETAILED DESCRIPTION

Figure 1:
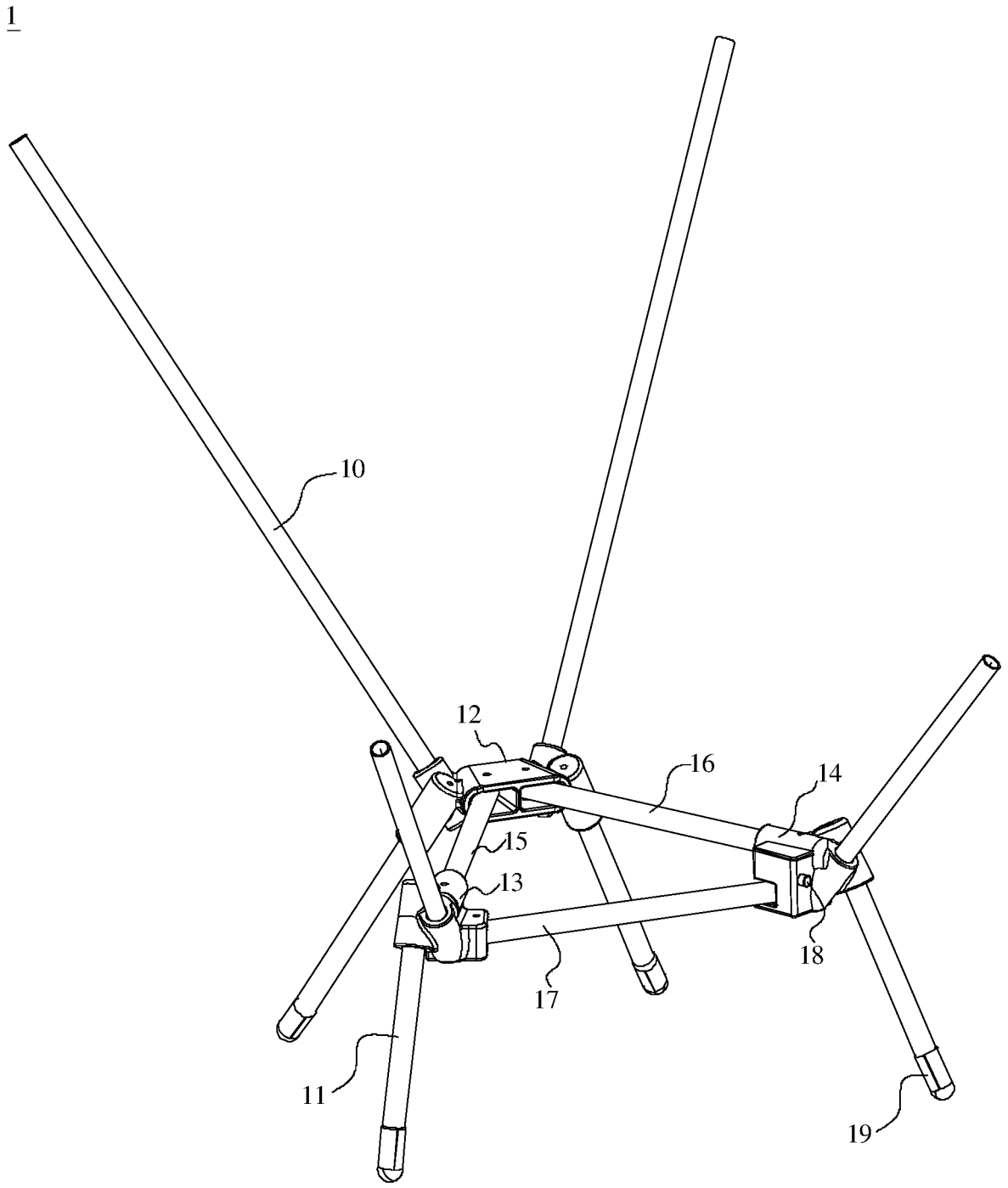
FIG. 1 is a schematic structural diagram of a first embodiment of a folding chair bracket of the present disclosure.

In order to make those of ordinary skill in the art understand objectives, technical solutions and advantages of the present disclosure more clearly, the present disclosure is further described in conjunction with accompanying drawings and embodiments below.

Referring to FIG. 1 to FIG. 8, FIG. 1 to FIG. 8 show a first embodiment of a folding chair bracket 1 of the present disclosure. In the embodiment shown in the figures, the folding chair bracket 1 includes a rear supporting seat 12, a left connecting rod 15, a right connecting rod 16, a left front supporting seat 13, a right front supporting seat 14, a front connecting rod 17, a plurality of supporting legs 11, a plurality of supporting rods 10 and a folding locking assembly 18. Rear ends of the left connecting rod 15 and the right connecting rod 16 are hinged with the rear supporting seat 12 to be capable of rotating in a horizontal direction, the left front supporting seat 13 and the right front supporting seat 14 are connected to front ends of the left connecting rod 15 and the right connecting rod 16 respectively, one side of the right front supporting seat 14 opposite to the left front supporting seat 13 is provided with a connecting recess 140 for accommodating the front connecting rod 17, a left end of the front connecting rod 17 is hinged to an inner side of the left front supporting seat 13 to be capable of rotating in the horizontal direction, and the folding locking assembly 18 is arranged on the right front supporting seat 14 and has a locked state and an unlocked state. In the locked state, the folding locking assembly 18 may lock and fix a right end of the front connecting rod 17 into the connecting recess 140 of the right front supporting seat 14. In the unlocked state, the front connecting rod 17 may be removed from the connecting recess 140. The supporting legs 11 are detachably inserted below the rear supporting seat 12, the left front supporting seat 13 and the right front supporting seat 14, and the supporting rods 10 are detachably inserted above the rear supporting seat 12, the left front supporting seat 13 and the right front supporting seat 14. Based on the above design, the rear supporting seat 12, and the left front supporting seat 13 and the right front supporting seat 14 which are located on one side of the rear supporting seat 12 are connected through the left connecting rod 15, the right connecting rod 16 and the front connecting rod 17 to form a triangular structure, and supporting is stable. The left end of the front connecting rod 17 is hinged with the left front supporting seat 13, the right end of the front connecting rod 17 may be locked into the connecting recess 140 of the right front supporting seat 14 through the folding locking assembly 18 to form the triangular structure for stabilizing supporting, and may also be unlocked from the right front supporting seat 14 and removed from the connecting recess 140 to move towards a direction close to the rear supporting seat 12, and at the same time, the left connecting rod 15 and the right connecting rod 16 move towards each other to achieve folding and storage of the folding chair bracket 1.

In some embodiments, the front connecting rod 17 is provided with a penetrating hole 170*a*, the folding locking assembly 18 includes a locking piece 180*a* and a pushing piece 181*a*, the locking piece 180*a* is located in the connecting recess 140, the pushing piece 181*a* is located on one side of the right front supporting seat 14, and one end of the pushing piece 181*a* penetrates through the right front supporting seat 14 to be connected with the locking piece 180*a* and may push the locking piece 180*a* to move up and down. When the folding chair bracket 1 needs to be unfolded, the pushing piece 181*a* pushes the locking piece 180*a* to move downwards, so that the locking piece 180*a* is clamped into the penetrating hole 170*a* to be in the locked state, and then the front connecting rod 17 is locked and fixed into the connecting recess 140 of the right front supporting seat 14. When the folding chair bracket 1 needs to be folded and stored, the pushing piece 181*a* pushes the locking piece 180*a* to move upwards, so that the locking piece 180*a* is removed from the penetrating hole 170*a* to be in the unlocked state, and the front connecting rod 17 may be removed from the connecting recess 140.

Specifically, in this embodiment, two protruding rods 1800*a* which protrude outwards are formed on two sides of the locking piece 180*a* respectively, the pushing piece 181*a* includes a key 1811*a* and two push rods 1812*a* correspondingly connected to two sides of the key 1811*a* respectively, the push rods 1812*a* include abutting rods 8121*a* located below the protruding rods 1800*a*, connecting rods 8123*a* connected with the key 1811*a*, and transition rods 8124*a* connected between the abutting rods 8121*a* and the connecting rods 8123*a*, and top surfaces of the transition rods 8124*a* are inclined surfaces, such that the locking piece 180*a* moves upwards when the key 1811*a* is pushed towards a direction close to the locking piece 180*a*. Based on the above design, the locking piece 180*a* is located between the two push rods 1812*a*, when the folding chair bracket 1 needs to be folded and stored, the key 1811*a* may be pushed, so that the key 1811*a* moves towards the direction close to the locking piece 180*a*, the two push rods 1812*a* move towards the direction close to the locking piece 180*a*, and the protruding rods 1800*a* move upwards along the transition rods 8124*a* to make the locking piece 180*a* move upwards to be removed from the penetrating hole 170*a*.

In some embodiments, a top of the right front supporting seat 14 is inwardly recessed to form an accommodating cavity 141*a*, the folding locking assembly 18 further includes a guiding piece 183*a*, the guiding piece 183*a* includes a cover plate 1831*a* and a hollow guiding column 1832*a* formed by extending downwards from a middle of the cover plate 1831*a*, the cover plate 1831*a* is arranged at a top of the accommodating cavity 141*a* in a covering mode, the guiding column 1832*a* penetrates through the accommodating cavity 141*a* to be located in the connecting recess 140, a side wall of the guiding column 1832*a* is provided with a sliding groove 8321*a*, and the protruding rods 1800*a* are located in the sliding groove 8321*a* and may move in the sliding groove 8321*a*, to drive the locking piece 180*a* to move up and down in the guiding column 1832*a*. Based on the above design, a movement path of the locking piece 180*a* may be limited through the guiding column 1832*a*.

Figure 4:
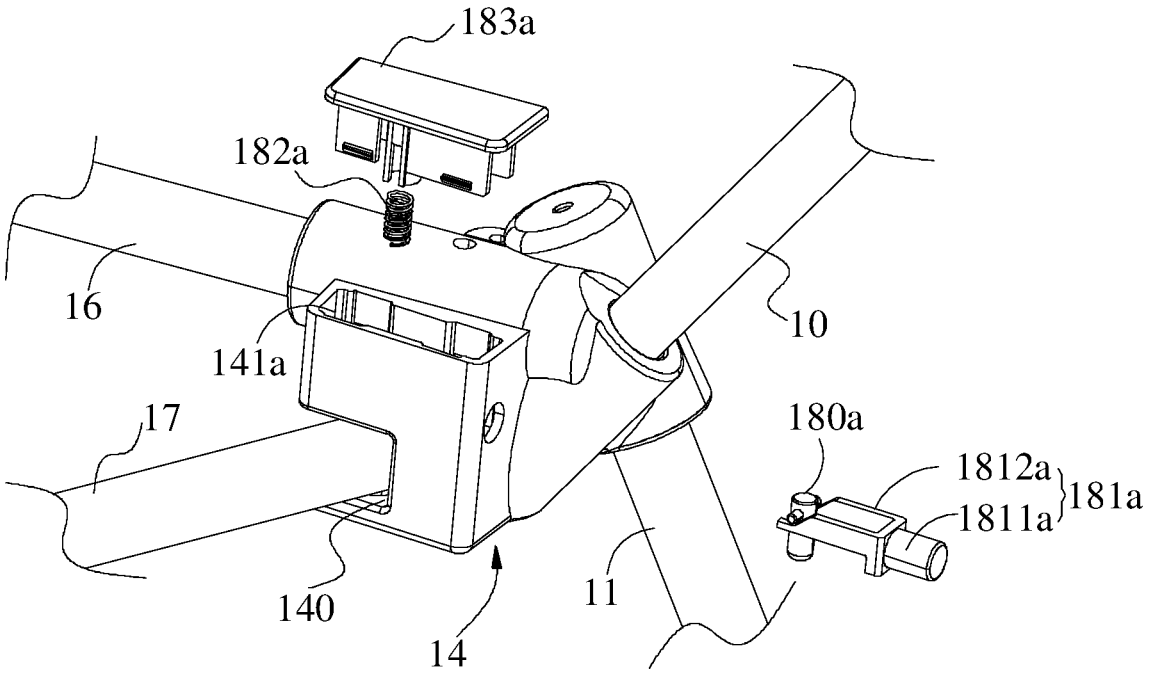
FIG. 4 is a partial schematic exploded view of a right front supporting seat in the folding chair bracket shown in FIG. 1.
Figure 5:
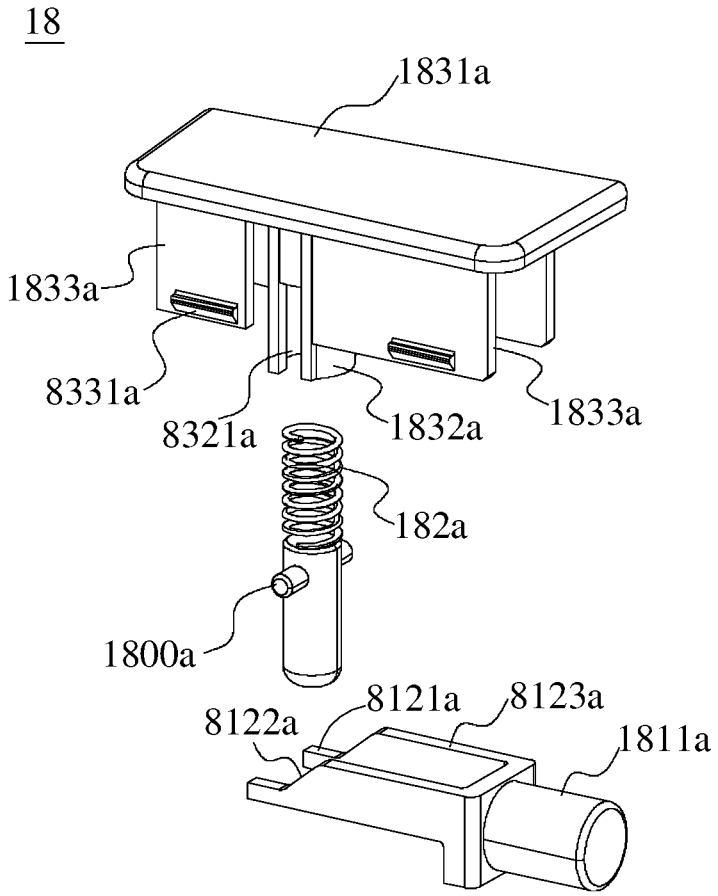
FIG. 5 is a schematic exploded view of a folding locking assembly in the folding chair bracket shown in FIG. 1.

Continuing to refer to FIG. 4 and FIG. 5, in some embodiments, a first protrusion part is formed on a cavity wall of the accommodating cavity 141*a*, the guiding piece 183*a* further includes side plates 1833 which are formed on two sides of the cover plate 1831*a*, and a second protrusion part 8331*a* matched with the first protrusion part is formed on each side plate 1833, to fix the guiding piece 183*a* onto the right front supporting seat 14.

Further, in this embodiment, the folding locking assembly 18 further includes an elastic piece 182*a*, the elastic piece 182*a* is located in the hollow guiding column 1832*a*, and two ends of the elastic piece 182*a* are connected with the locking piece 180*a* and the cover plate 1831*a* respectively, so that the elastic piece 182*a* compresses when the pushing piece 181*a* pushes the locking piece 180*a* to move upwards and enables the locking piece 180*a* to be quickly clamped into the penetrating hole 170*a* under an elastic action. Based on this design, when the pushing piece 181*a* pushes the locking piece 180*a* to be removed from the penetrating hole 170*a* to be unlocked, the elastic piece 182*a* compresses, and when the front connecting rod 17 needs to be locked, the elastic piece 182*a* may be quickly clamped into the penetrating hole 170*a* under the elastic action.

Figure 3:
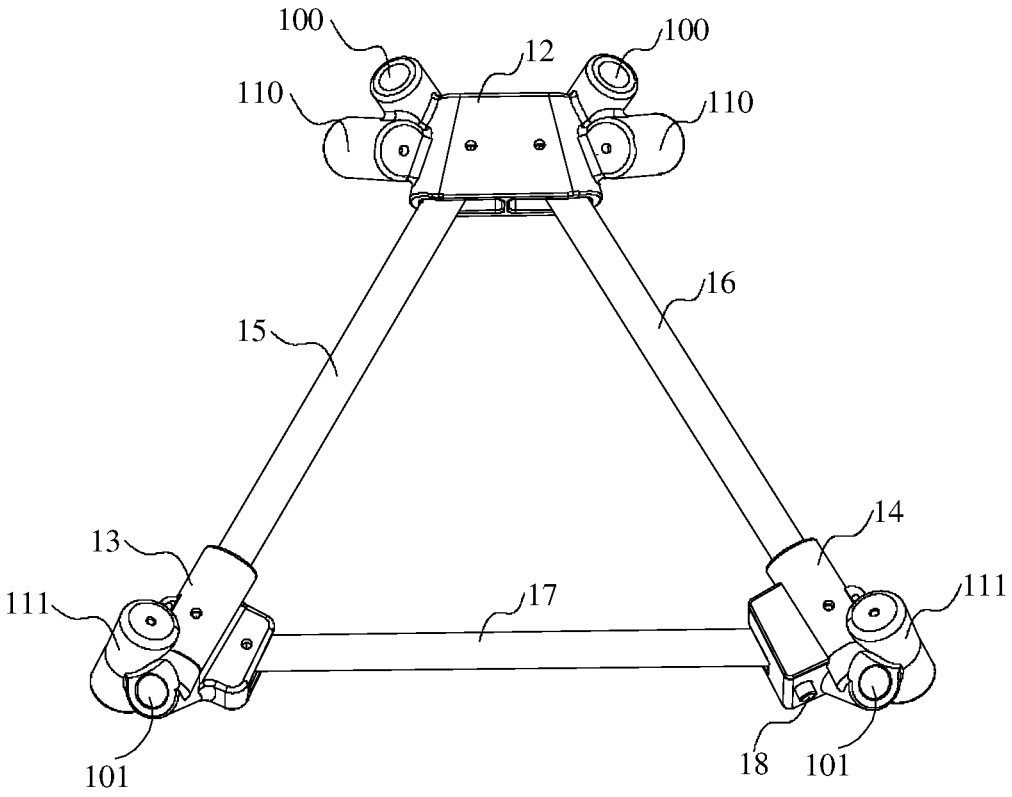
FIG. 3 is a schematic structural diagram of the folding chair bracket shown in FIG. 1 after removing a supporting rod and supporting legs.
Figure 6:
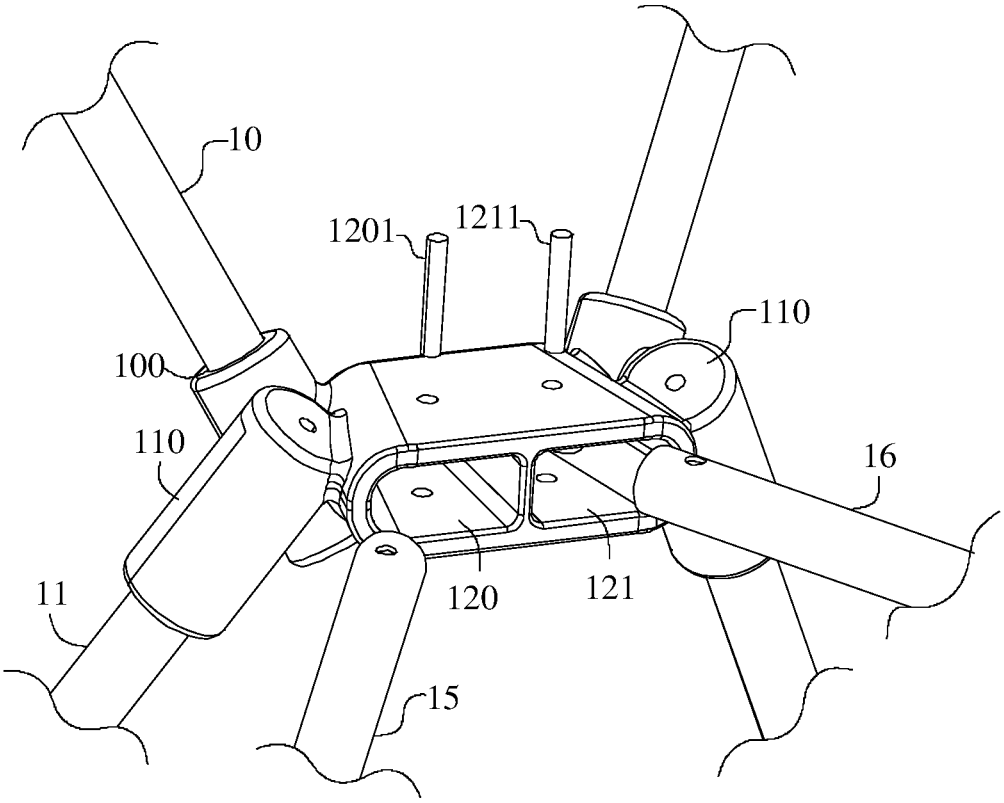
FIG. 6 is a schematic exploded view of a rear supporting seat in the folding chair bracket shown in FIG. 1.

Continuing to refer to FIG. 1, FIG. 3 and FIG. 6, two sides of the front end of the rear supporting seat 12 are inwardly recessed respectively to form a first rear cavity 120 and a second rear cavity 121 which are symmetrical left and right, and the left connecting rod 15 and the right connecting rod 16 are located in the first rear cavity 120 and the second rear cavity 121 respectively, and are hinged with the rear supporting seat 12 through a first assembly shaft 1201 and a second assembly shaft 1211 respectively. That is, the first assembly shaft 1201 penetrates through the top of the rear supporting seat 12 to enter the first rear cavity 120, and penetrates through the left connecting rod 15 and a bottom of the rear supporting seat 12, so that the left connecting rod 15 may rotate with the first assembly shaft 1201 as an axis within a range limited by the first rear cavity 120. The second assembly shaft 1211 penetrates through the top of the rear supporting seat 12 to enter the second rear cavity 121, and penetrates through the right connecting rod 16 and the bottom of the rear supporting seat 12, so that the right connecting rod 16 may rotate with the second assembly shaft 1211 as an axis within a range limited by the second rear cavity 121. Therefore, the left connecting rod 15 and the right connecting rod 16 are hinged with the rear supporting seat 12.

Figure 7:
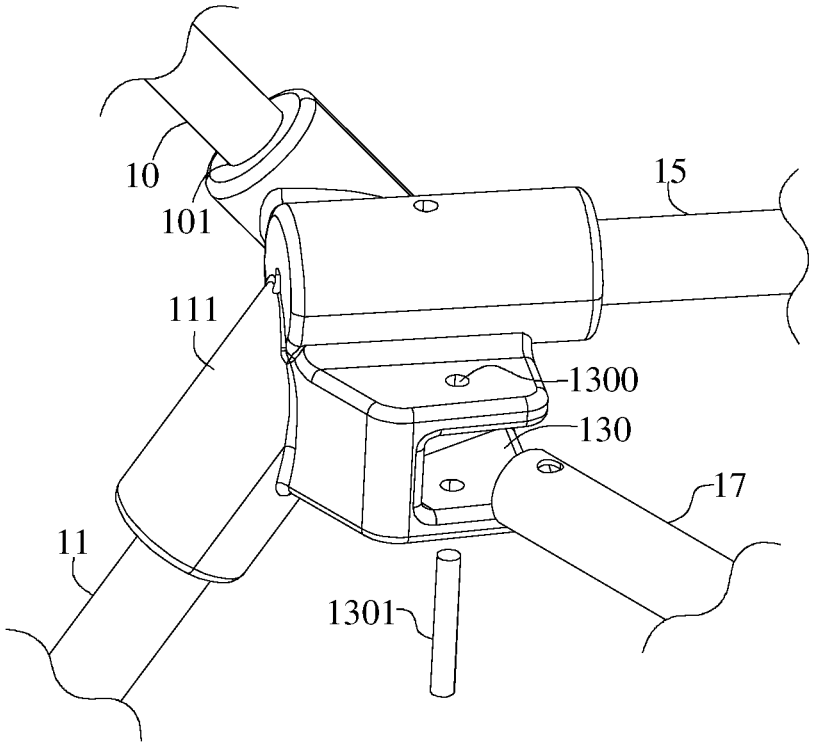
FIG. 7 is a schematic exploded view of a left front supporting seat in the folding chair bracket shown in FIG. 1.

Continuing to refer to FIG. 1 and FIG. 7, in this embodiment, the left front supporting seat 13 is provided with a left cavity 130, upper and lower sides of the left cavity 130 are each provided with a third assembly hole 1300 which is oppositely through, one end of the front connecting rod 17 is located in the left cavity 130, and a third assembly shaft 1301 sequentially penetrates through the third assembly hole 1300 located in the upper part of the left cavity 130, the front connecting rod 17 and the third assembly hole 1300 located in the lower part of the left cavity 130, so that the front connecting rod 17 is hinged onto the left front supporting seat 13.

Preferably, in this embodiment, two sides of the rear supporting seat 12 are provided with two first upper plug barrels 100 with inclined upwards openings and two first lower plug barrels 110 with inclined downwards openings respectively, outer sides of the left front supporting seat 13 and the right front supporting seat 14 are provided with second upper plug barrels 101 with inclined upwards openings and second lower plug barrels 111 with inclined downwards openings, the supporting rods 10 are detachably inserted into each first upper plug barrel 100 and each second upper plug barrel 101 respectively, so that the supporting rods 10 are inclined upwards and outwards, and the supporting legs 11 which are inclined downwards are detachably inserted into each first lower plug barrel 110 and each second lower plug barrel 111 respectively, so that the supporting legs 11 are inclined downwards and outwards. Anti-skidding sleeves 19 are arranged on the supporting legs 11 in a sleeving mode, to enhance friction with the ground when the folding chair bracket 1 is in an unfolded state, which is safe and anti-skidding. It may be understood that the supporting legs 11 and the supporting rods 10 may be made into telescopic rods according to the required length of use, and may also be arranged as rods with the fixed lengths.

Figure 2:
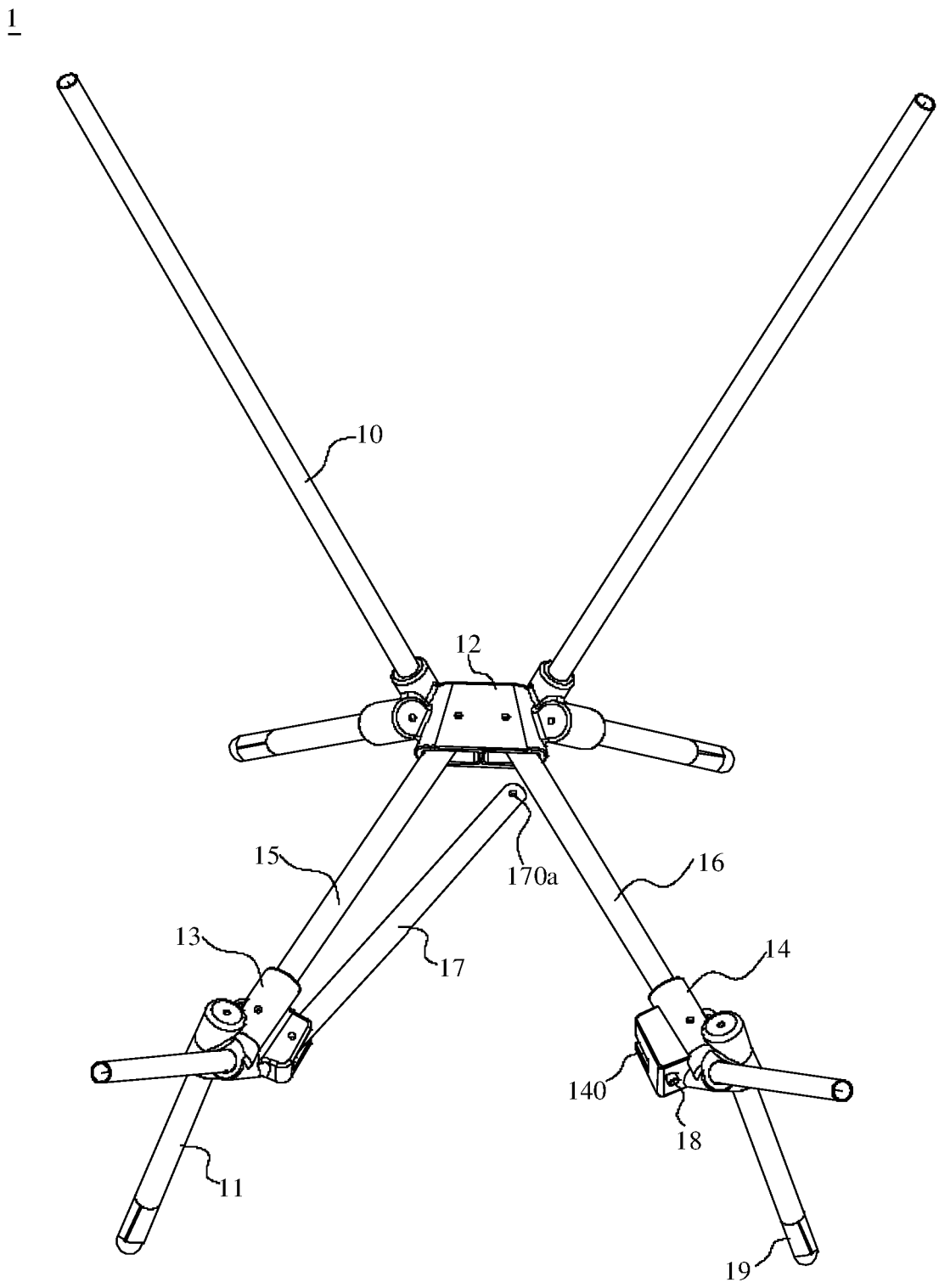
FIG. 2 is a schematic diagram of an unfolding process of the folding chair bracket shown in FIG. 1.
Figure 8:
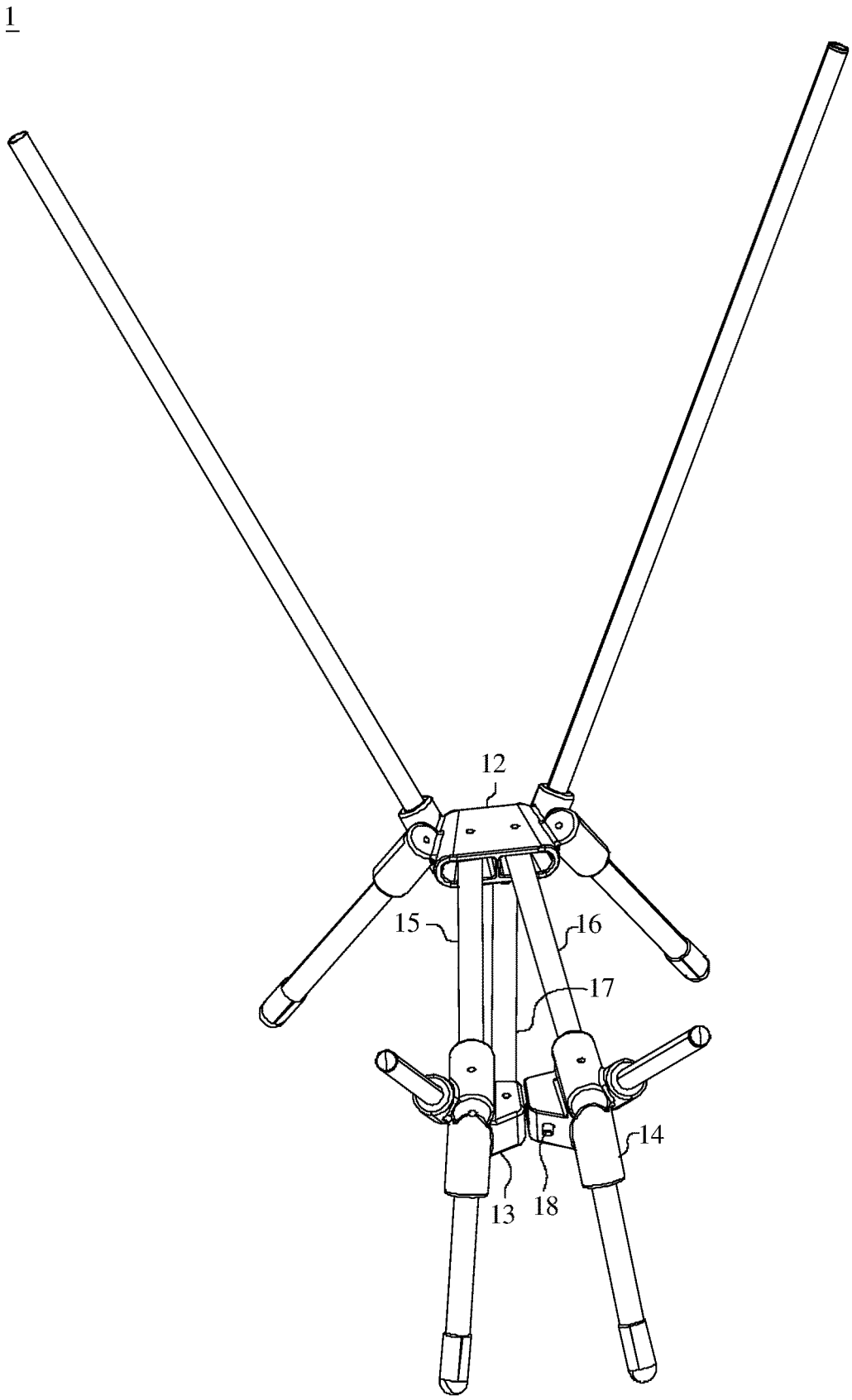
FIG. 8 is a schematic diagram of the folding chair bracket shown in FIG. 1 in a fully folded state.

With reference to FIG. 1, FIG. 2 and FIG. 8, a use process of the folding chair bracket 1 in this embodiment is specifically described. During unfolding, firstly, the left connecting rod 15 is rotated leftwards to an extreme position, the right connecting rod 16 is rotated rightwards to an extreme position, and at the moment, the folding chair bracket 1 is as shown in FIG. 2. Then, the front connecting rod 17 is pulled to rotate around the third assembly shaft 1301, at the same time, the key 1811*a* is pushed, so that the locking piece 180*a* moves upwards, after the right end of the front connecting rod 17 moves into the connecting recess 140 of the right front supporting seat 14, the key 1811*a* is released, the locking piece 180*a* moves downwards under the elastic action of the elastic piece 182*a*, to be quickly clamped into the penetrating hole 170*a* of the front connecting rod 17, so that the front connecting rod 17 is locked into the connecting recess 140, the folding chair bracket 1 is as shown in FIG. 1, and unfolding and fixing are completed. When the folding chair bracket 1 is folded and stored, firstly, the key 1811*a* arranged on the right front supporting seat 14 is pushed, so that the push rods 1812*a* connected with the key 1811*a* move towards the direction close to the locking piece 180*a*, the protruding rods 1800*a* of the locking piece 180*a* move from the abutting rods 8121*a* to the transition rods 8124*a*, because the top surfaces of the transition rods 8124*a* are inclined surfaces which incline upwards, and the protruding rods 1800*a* move along the top surfaces of the transition rods 8124*a*, the locking piece 180*a* moves upwards and is removed from the penetrating hole 170*a*, then the front connecting rod 17 is operated to rotate towards a direction close to the rear supporting seat 12, to be separated from the right front supporting seat 14 and move to a position below the rear supporting seat 12, then the left connecting rod 15 is rotated rightwards to an extreme position, the right connecting rod 16 is rotated leftwards to an extreme position, as shown in FIG. 8, and storage and folding of the folding chair bracket 1 are completed. Further, the supporting rods 10 and the supporting legs 11 may further be detached, so that the folding chair bracket 1 is more compact during folding and storage, and is easy to carry.

Referring to FIG. 9 to FIG. 15, FIG. 9 to FIG. 15 show a second embodiment of a folding chair bracket 1 of the present disclosure. The difference between this embodiment and the first embodiment lies in a specific structure of the folding locking assembly 18 and its connection relationship with the front connecting rod 17 and the right front supporting seat 14, and other structures are the same or similar. In this embodiment, the folding locking assembly 18 includes a sleeve rod 180*b* and a lock piece 181*b*, a right end of the front connecting rod 17 is connected with the sleeve rod 180*b*, the lock piece 181*b* includes a push-pull piece and a fixing piece 1811*b*, and the fixing piece 1811*b* is fixed into the connecting recess 140. In this embodiment, a clamping groove 1401*b* is formed in a lower wall of the connecting recess 140, the fixing piece 1811*b* is fixed into the clamping groove 1401*b*, the fixing piece 1811*b* is inwards provided, from an end thereof, with a penetrating sliding groove 8110*b* allowing the sleeve rod 180*b* to pass through, a hook claw 8103*b* is formed on the push-pull piece, and the push-pull piece is located on one side of the fixing piece 1811*b*. When in a locked state, the push-pull piece moves upwards until the hook claw 8103*b* is hooked on the sleeve rod 180*b*, to be matched with the fixing piece 1811*b* to lock and fix the sleeve rod 180*b* into the penetrating sliding groove 8110*b*. When in an unlocked state, the push-pull piece moves downwards, and the sleeve rod 180*b* is removed from the hook claw 8103*b* and the penetrating sliding groove 8110*b*. It may be understood that one end of the penetrating sliding groove 8110*b* is open. Preferably, in this embodiment, an opening end 8111*b* of the penetrating sliding groove 8110*b* is in a trumpet shape, so that the sleeve rod 180*b* is convenient to move in and out. Based on the above design, the folding chair bracket 1 in this embodiment is also stable in supporting and may be quickly unfolded and folded and stored, which is convenient to operate. That is, when the folding chair bracket 1 needs to be unfolded, the front connecting rod 17 is moved to make the right end of the front connecting rod 17 move towards the direction close to the right front supporting seat 14 until the sleeve rod 180*b* connected with the right end of the front connecting rod 17 moves into the connecting recess 140 of the right front supporting seat 14, and enter the other end part of the penetrating sliding groove 8110*b* from the opening end 8111*b* of the penetrating sliding groove 8110*b*. At the moment, the push-pull piece moves upwards, so that the hook claw 8103*b* is hooked on the sleeve rod 180*b* to be matched with the fixing piece 1811*b* to lock and fix the sleeve rod 180*b* into the penetrating sliding groove 8110*b*, that is, the sleeve rod 180*b* cannot move towards a direction away from the right front supporting seat 14 under the action of the hook claw 8103*b*, and unfolding and stabilization of the folding chair bracket 1 are achieved. When the folding chair bracket 1 needs to be folded, the push-pull piece moves downwards, so that the sleeve rod 180*b* is removed from the hook claw 8103*b*, and then the sleeve rod 180*b* may be removed from the opening end 8111*b* of the penetrating sliding groove 8110*b*, to be removed from the connecting recess 140 of the right front supporting seat 14.

Continuing to refer to FIG. 9, and FIG. 12 to FIG. 14, in some embodiments, a top of the right front supporting seat 14 is provided with an accommodating cavity 141*b*, the push-pull piece includes a push button 8101*b* located on the accommodating cavity 141*b* and a push-pull plate 8102*b* located in the connecting recess 140, the hook claw 8103*b* is formed at one end part of the push-pull plate 8102*b* and forms a hook groove 8104*b* with the push-pull plate 8102*b*, and the other end part of the push-pull plate 8102*b* penetrates through the right front supporting seat 14 to be connected with the push button 8101*b*, to move up and down under the action of the push button 8101*b*. Preferably, a position of a lower wall of the connecting recess 140 corresponding to the push-pull plate 8102*b* is provided with a notch 1400*b*. Based on the above design, when the push-pull piece moves upwards, and the hook claw 8103*b* is hooked on the sleeve rod 180*b*, the sleeve rod 180*b* is located in the hook groove 8104*b*. When the push-pull piece moves downwards, a bottom of the push-pull plate 8102*b* may penetrate through the notch 1400*b*, to avoid affecting the removal of the sleeve rod 180*b*.

Specifically, in this embodiment, the push-pull plate 8102*b* includes a vertical plate 8106*b* and a transverse plate 8105*b* formed by bending outwards from one end of the vertical plate 8106*b*, the other end of the vertical plate 8106*b* is connected with the push button 8101*b*, the notch 1400*b* is formed in a position of the lower wall of the connecting recess 140 corresponding to the transverse plate 8105*b*, the hook claw 8103*b* is formed at an outer side of an upper end of the transverse plate 8105*b*, and the hook claw 8103*b* forms the hook groove 8104*b* with the transverse plate 8105*b* and the vertical plate 8106*b*.

In some embodiments, the sleeve rod 180*b* includes a connecting sleeve 1800*b* and a locking rod 1801*b* formed by extending outwards from a middle of one end of the connecting sleeve 1800*b* and used for being matched with the lock piece 181*b*, the connecting sleeve 1800*b* is sleeved with the front connecting rod 17, and a penetrating shaft 1803*b* penetrates through the front connecting rod 17 and the connecting sleeve 1800*b* to fix the connecting sleeve 1800*b* into the front connecting rod 17. Preferably, the sleeve rod 180*b* further includes a clamp cap 1802*b* formed at a tail end of the locking rod 1801*b*, the locking rod 1801*b* is of a cylindrical structure, the clamp cap 1802*b* is of a spherical structure, and a diameter of the clamp cap 1802*b* is greater than a diameter of the locking rod 1801*b*. Based on this design, the clamp cap 1802*b* may prevent the locking rod 1801*b* from being separated from the penetrating sliding groove 8110*b* and the hook groove 8104*b*.

Further, in this embodiment, the push-pull piece further includes an elastic piece 182*b*, and the elastic piece 182*b* is connected with the push-pull plate 8102*b* and an inner wall of the push button 8101*b*, to compress when the push button 8101*b* pushes the push-pull plate 8102*b* to move downwards, and enable the hook claw 8103*b* on the push-pull plate 8102*b* to be quickly hooked on the sleeve rod 180*b* under an elastic action. Specifically, in this embodiment, the elastic piece 182*b* is arranged at one end of the vertical plate 8106*b* connected with the push button 8101*b* in a sleeving mode, and moves downwards following the vertical plate 8106*b* when the push button 8101*b* pushes the vertical plate 8106*b* to move downwards, and the elastic piece 182*b* compresses when a lower end abuts against a top of the fixing piece 1811*b*. Based on the design of the elastic piece 182*b*, when the push button 8101*b* pushes the push-pull plate 8102*b* to move downwards to be unlocked under an external force action, the elastic piece 182*b* compresses. When the front connecting rod 17 needs to be locked, the hook claw 8103*b* may be quickly hooked on the sleeve rod 180*b* connected with the front connecting rod 17 under the elastic action of the elastic piece 182*b*.

Figure 9:
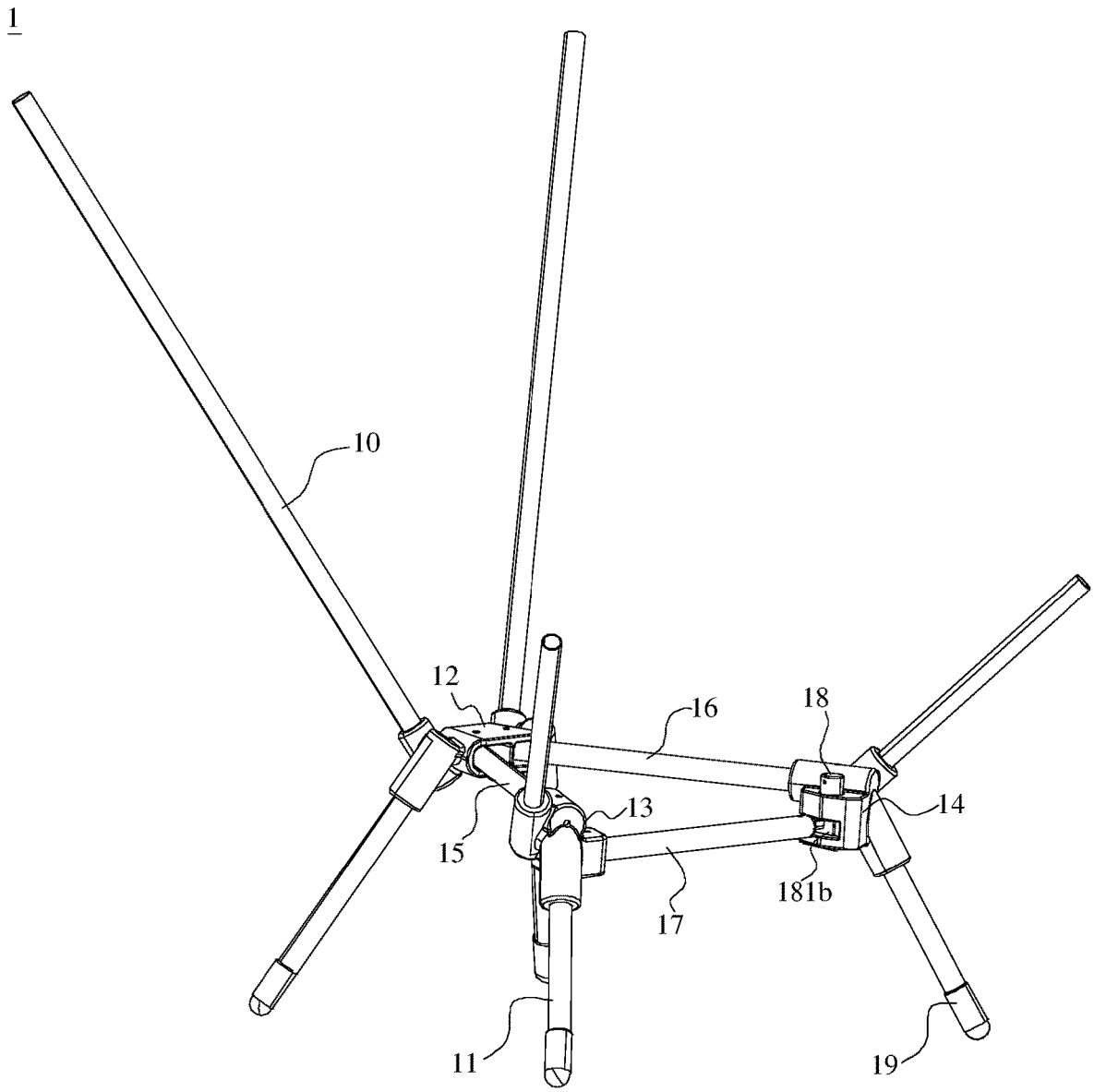
FIG. 9 is a schematic structural diagram of a second embodiment of a folding chair bracket of the present disclosure.
Figure 10:
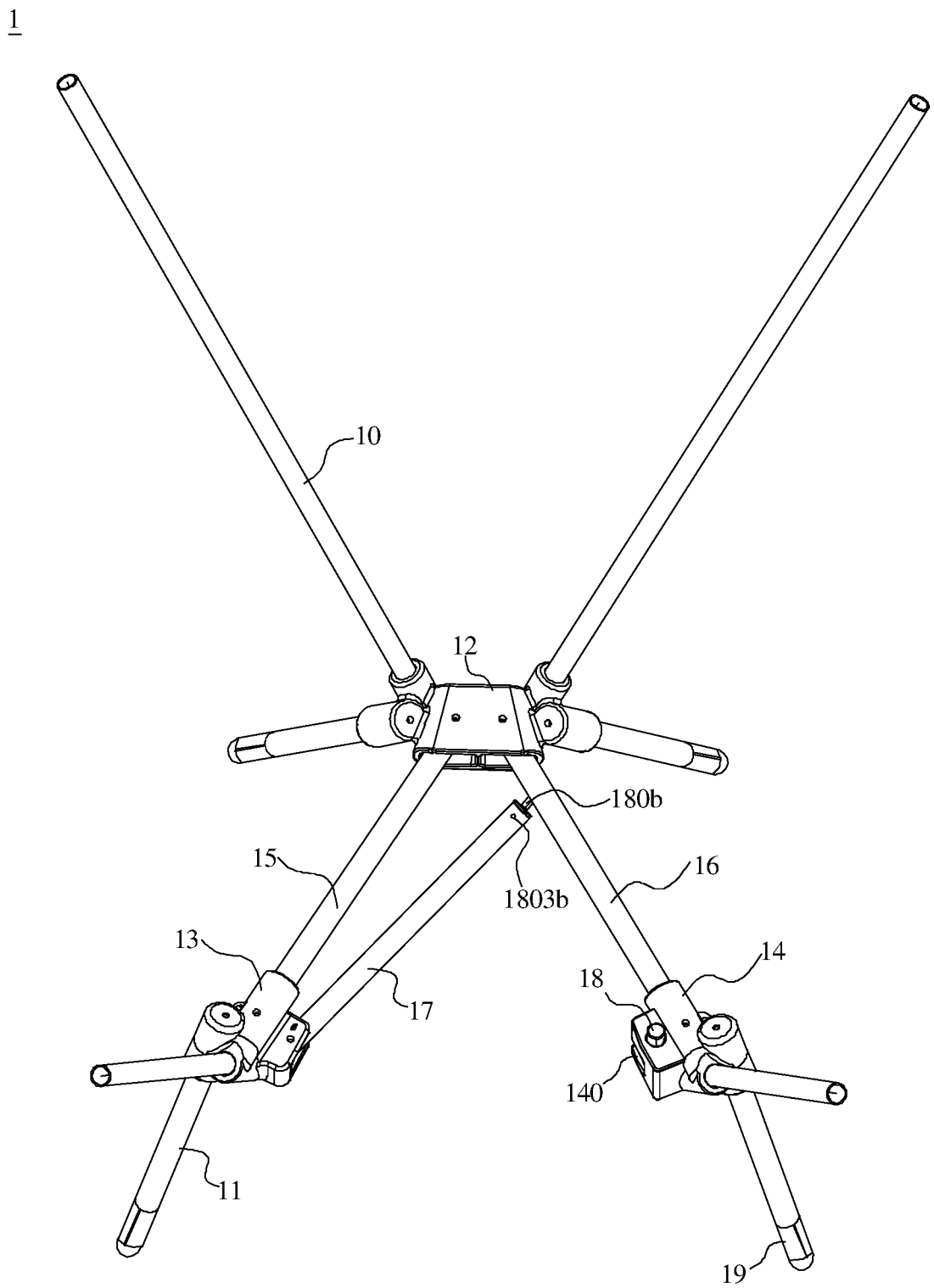
FIG. 10 is a schematic diagram of an unfolding process of the folding chair bracket shown in FIG. 9.
Figure 11:
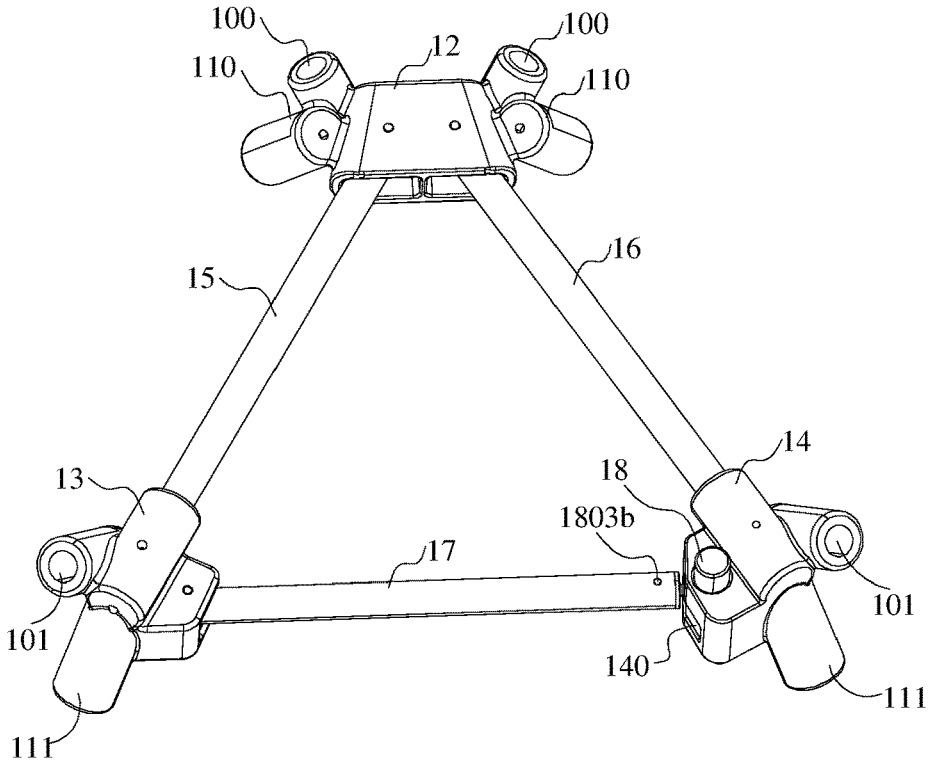
FIG. 11 is a schematic structural diagram of the folding chair bracket shown in FIG. 9 after removing a supporting rod and supporting legs.
Figure 12:
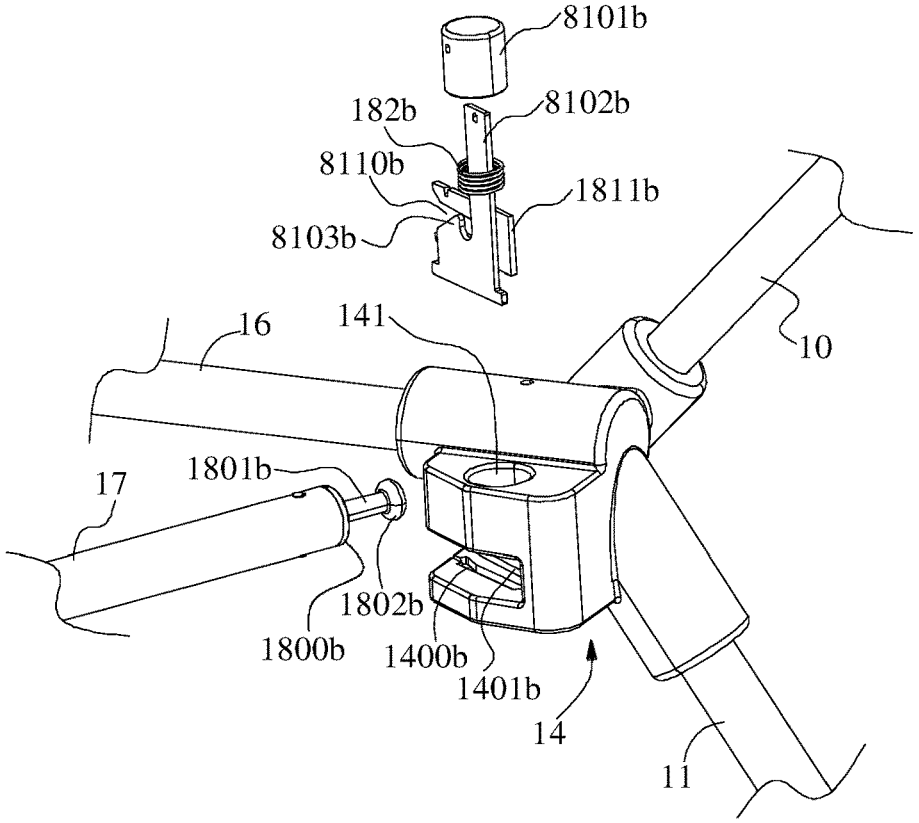
FIG. 12 is a partial schematic exploded view of a right front supporting seat in the folding chair bracket shown in FIG. 9.
Figure 13:
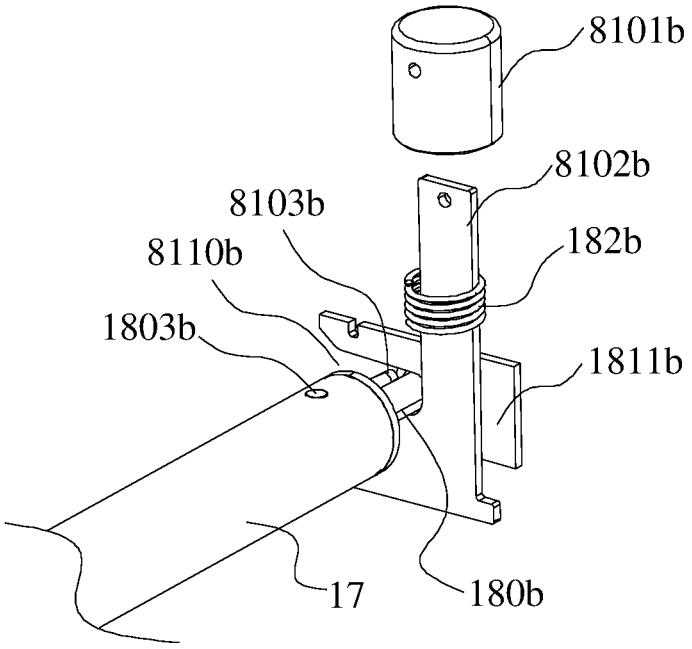
FIG. 13 is a schematic matching diagram of a front connecting rod and a folding locking assembly in the folding chair bracket shown in FIG. 9.
Figure 14:
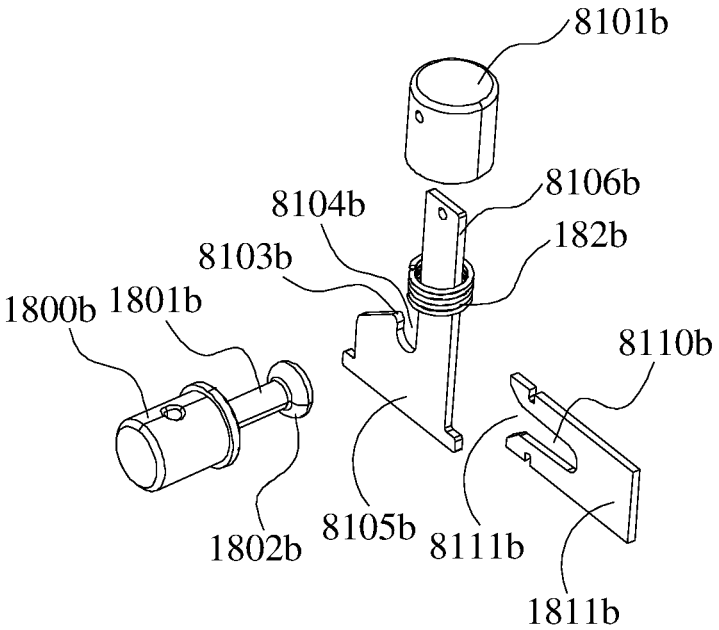
FIG. 14 is a schematic exploded view of a folding locking assembly in the folding chair bracket shown in FIG. 9.
Figure 15:
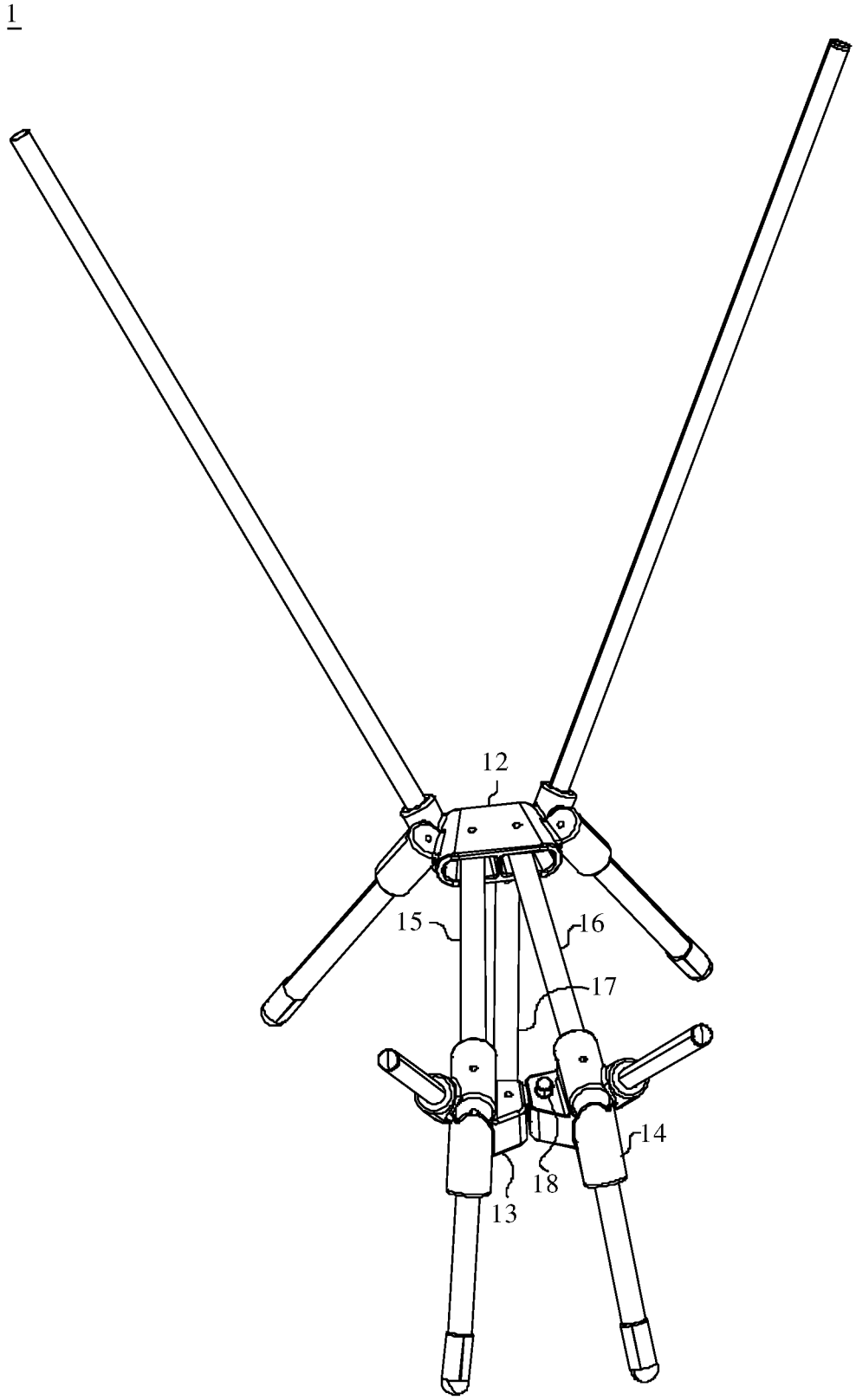
FIG. 15 is a schematic diagram of the folding chair bracket shown in FIG. 9 in a fully folded state.

With reference to FIG. 9, FIG. 10 and FIG. 15, a use process of the folding chair bracket 1 in this embodiment is specifically described. During unfolding, firstly, the left connecting rod 15 is rotated leftwards to an extreme position, the right connecting rod 16 is rotated rightwards to an extreme position, and at the moment, the folding chair bracket 1 is as shown in FIG. 10. Then, the front connecting rod 17 is pulled to rotate around the third assembly shaft 1301, at the same time, the push button 8101*b* is pushed, so that the push-pull plate 8102*b* in the lock piece 181*b* moves downwards, after the sleeve rod 180*b* connected with the front connecting rod 17 moves into the connecting recess 140 of the right front supporting seat 14, and its locking rod 1801*b* enters the other end part of the penetrating sliding groove 8110*b* from the opening end 8111*b* of the penetrating sliding groove 8110*b*, then the push button 8101*b* is released, the push-pull plate 8102*b* connected with the push button 8101*b* moves upwards under the elastic action of the elastic piece 182*b*, so that the hook claw 8103*b* on the push-pull plate 8102*b* is quickly hooked on the sleeve rod 180*b*, to lock the front connecting rod 17 in the connecting recess 140, the folding chair bracket 1 is as shown in FIG. 9, and unfolding and fixing are completed. When the folding chair bracket 1 is folded and stored, firstly, the push button 8101*b* arranged on the right front supporting seat 14 is pushed, so that the push-pull plate 8102*b* connected with the push button 8101*b* moves towards a direction close to the notch 1400*b* in the right front supporting seat 14, and the locking rod 1801*b* of the sleeve rod 180*b* is separated from the hook groove 8104*b*, the locking rod 1801*b* may be removed from the opening end 8111*b* of the penetrating sliding groove 8110*b*, to be removed from the connecting recess 140 of the right front supporting seat 14, then the front connecting rod 17 is operated to rotate towards a direction close to the rear supporting seat 12, to be separated from the right front supporting seat 14 and move to a position below the rear supporting seat 12, then the left connecting rod 15 is rotated rightwards to an extreme position, the right connecting rod 16 is rotated leftwards to an extreme position, as shown in FIG. 15, and storage and folding of the folding chair bracket 1 are completed. Further, the supporting rods 10 and the supporting legs 11 may further be detached, so that the folding chair bracket 1 is more compact during folding and storage, and is easy to carry.

Referring to FIG. 16 to FIG. 23, FIG. 16 to FIG. 23 show a third embodiment of a folding chair bracket 1 of the present disclosure. The difference between this embodiment and the first embodiment lies in a specific structure of the folding locking assembly 18 and its connection relationship with the front connecting rod 17 and the right front supporting seat 14, and other structures are the same or similar. In this embodiment, a first positioning hole 1401*c* is formed in a top surface of the connecting recess 140, a second positioning hole 1402*c* is formed in a bottom surface of the connecting recess 140, the folding locking assembly 18 includes an elastic piece 170*c* arranged in a right end of the front connecting rod 17, the elastic piece 170*c* is provided with a first positioning column 1701*c* which protrudes above the front connecting rod 17 and a second positioning column 1702*c* which protrudes below the front connecting rod 17, the first positioning column 1701*c* and the second positioning column 1702*c* may be retracted into the front connecting rod 17 under external force action, and when the right end of the front connecting rod 17 is placed into the connecting recess 140, the first positioning column 1701*c* and the second positioning column 1702*c* are correspondingly inserted into the first positioning hole 1401*c* and the second positioning hole 1402*c*, to achieve the connection of the front connecting rod 17 and the right front supporting seat 14. Based on the above design, during use, the first positioning column 1701*c* and the second positioning column 1702*c* may be correspondingly inserted into the first positioning hole 1401*c* and the second positioning hole 1402*c* respective by using an elastic force, to lock and fix the front connecting rod 17 to achieve unfolding of the folding chair bracket 1. The first positioning column 1701*c* and the second positioning column 1702*c* may further be extruded simultaneously from upper and lower sides for unlocking, to achieve folding and storage of the folding chair bracket 1, which is simple in structure and easy to operate.

Figure 17:
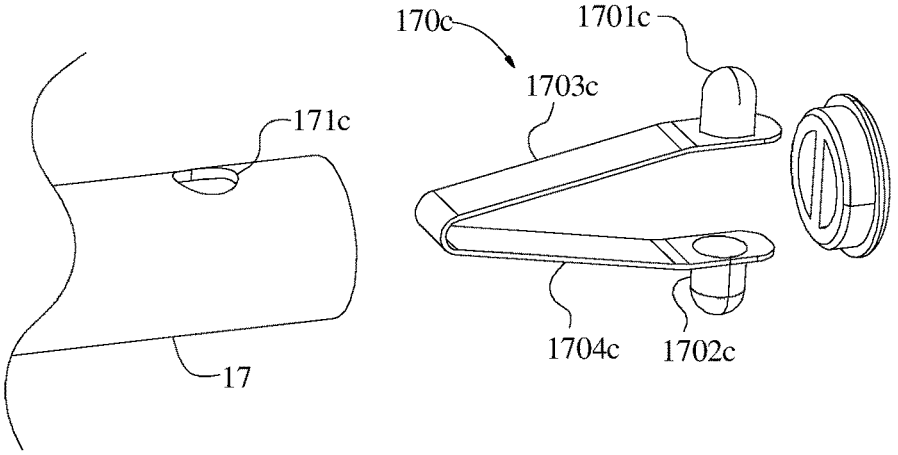
FIG. 17 is a schematic matching diagram of a front connecting rod and a folding locking assembly in the folding chair bracket shown in FIG. 16.
Figure 21:
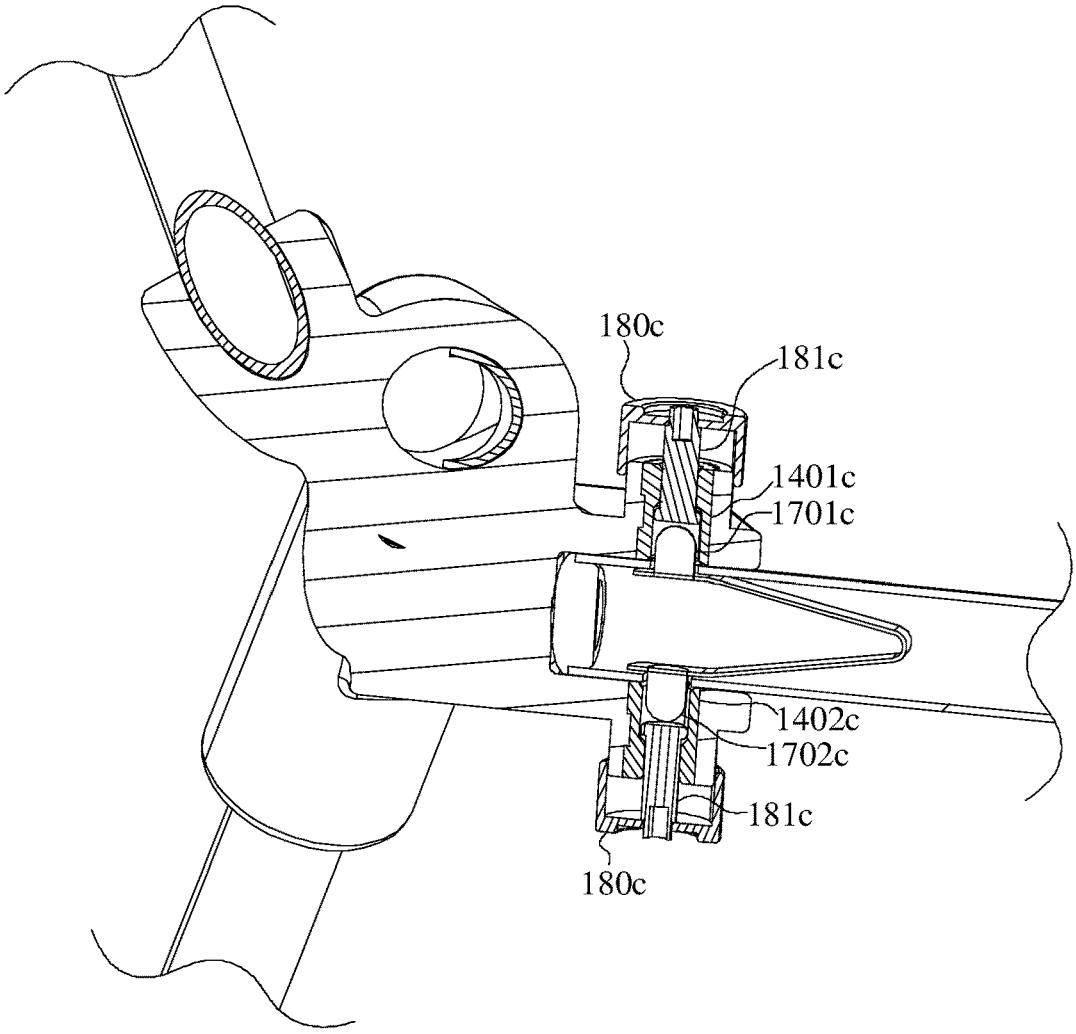
FIG. 21 is a schematic cross-sectional view after the front connecting rod is clamped with the right front supporting seat shown in FIG. 20.

Continuing to refer to FIG. 17 and FIG. 21, in this embodiment, the elastic piece 170*c* is in a V shape, including a first spring sheet 1703*c* inclined upwards and a second spring sheet 1704*c* inclined downwards, the first positioning column 1701*c* is vertically formed at a tail end of the first spring sheet 1703*c* upwards, the second positioning column 1702*c* is vertically formed at a tail end of the second spring sheet 1704*c* downwards, a clamp hole 171*c* which is through up and down is formed in the right end of the front connecting rod 17, and the clamp hole 171*c* is adaptive to the first positioning column 1701*c* and the second positioning column 1702*c* in shape. When the elastic piece 170*c* is placed into the front connecting rod 17, the first positioning column 1701*c* penetrates through the clamp hole 171*c* to protrude above the front connecting rod 17, the second positioning column 1702*c* penetrates through the clamp hole 171*c* to protrude below the front connecting rod 17, and under the external force action, the first positioning column 1701*c* and the second positioning column 1702*c* may be extruded to be retracted into the front connecting rod 17.

Continuing to refer to FIG. 18 to FIG. 21, the connecting recess 140 on an inner side of the right front supporting seat 14 is provided with the first positioning hole 1401*c* in a top surface and the second positioning hole 1402*c* in a bottom surface. In order to guide and transition the rotation and assembly of the front connecting rod 17, in this embodiment, a concave first guiding surface 1403*c* is formed on the top surface of the connecting recess 140 corresponding to the first positioning hole 1401*c*, and a concave second guiding surface 1404*c* is formed on the bottom surface of the connecting recess 140 corresponding to the second positioning hole 1402*c*. Taking the center of the first positioning hole 1401*c* and the second positioning hole 1402*c* as the inside, and a position away from the first positioning hole 1401*c* and the second positioning hole 1402*c* as the outside, the first guiding surface 1403*c* gradually retracts and descends obliquely from the outside to the inside, and the second guiding surface 1404*c* gradually retracts and ascends obliquely from the outside to the inside.

As shown in the figures, when the right end of the front connecting rod 17 is rotated to the connecting recess 140, the first positioning column 1701*c* abuts against the first guiding surface 1403*c*, and the second positioning column 1702*c* abuts against the second guiding surface 1404*c*. As the front connecting rod 17 further rotates, the first guiding surface 1403*c* descends obliquely to gradually extrude the first positioning column 1701*c* downwards, and the second guiding surface 1404*c* ascends obliquely to gradually extrude the second positioning column 1702*c* upwards until the first positioning column 1701*c* and the second positioning column 1702*c* are correspondingly inserted into the first positioning hole 1401*c* and the second positioning hole 1402*c*. The rotation and assembly of the front connecting rod 17 are guided and transitioned by arranging the first guiding surface 1403*c* and the second guiding surface 1404*c*, without manual extruding of the first positioning column 1701*c* and the second positioning column 1702*c*, which reduces an extrusion force on the first positioning column 1701*c* and the second positioning column 1702*c*, and is convenient and labor-saving.

Figure 18:
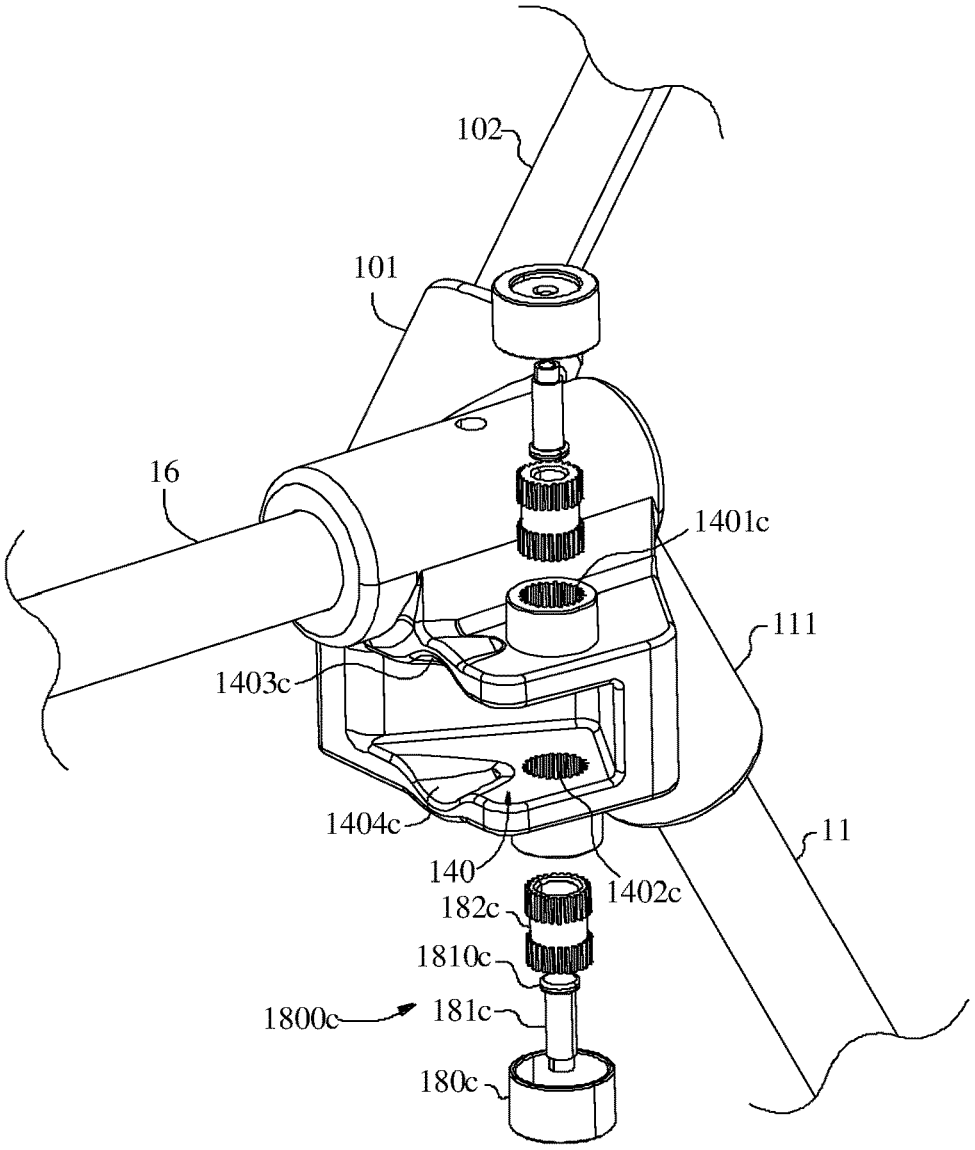
FIG. 18 is a partial schematic exploded view of a right front supporting seat in the folding chair bracket shown in FIG. 16.
Figure 19:
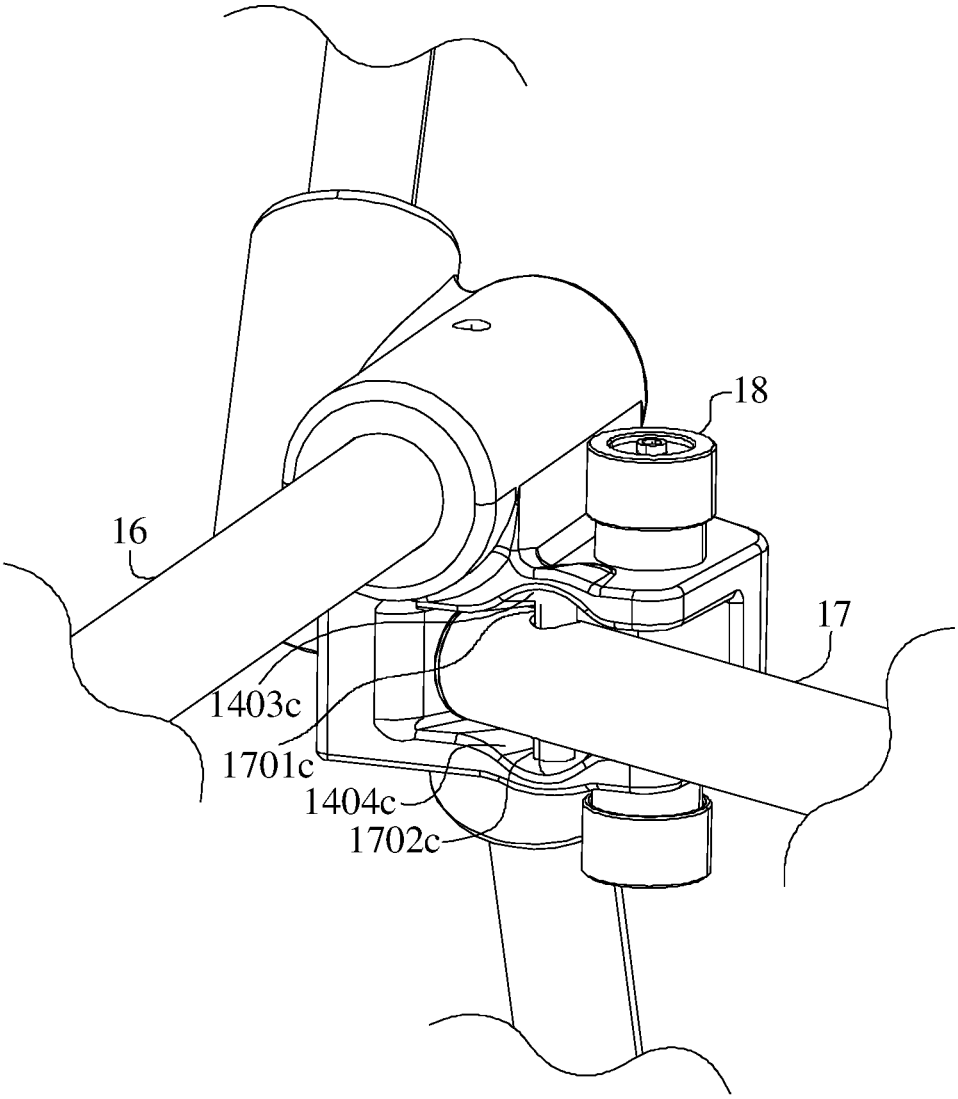
FIG. 19 is a schematic diagram of a process of a front connecting rod rotating into a right front supporting seat in a third embodiment.
Figure 20:
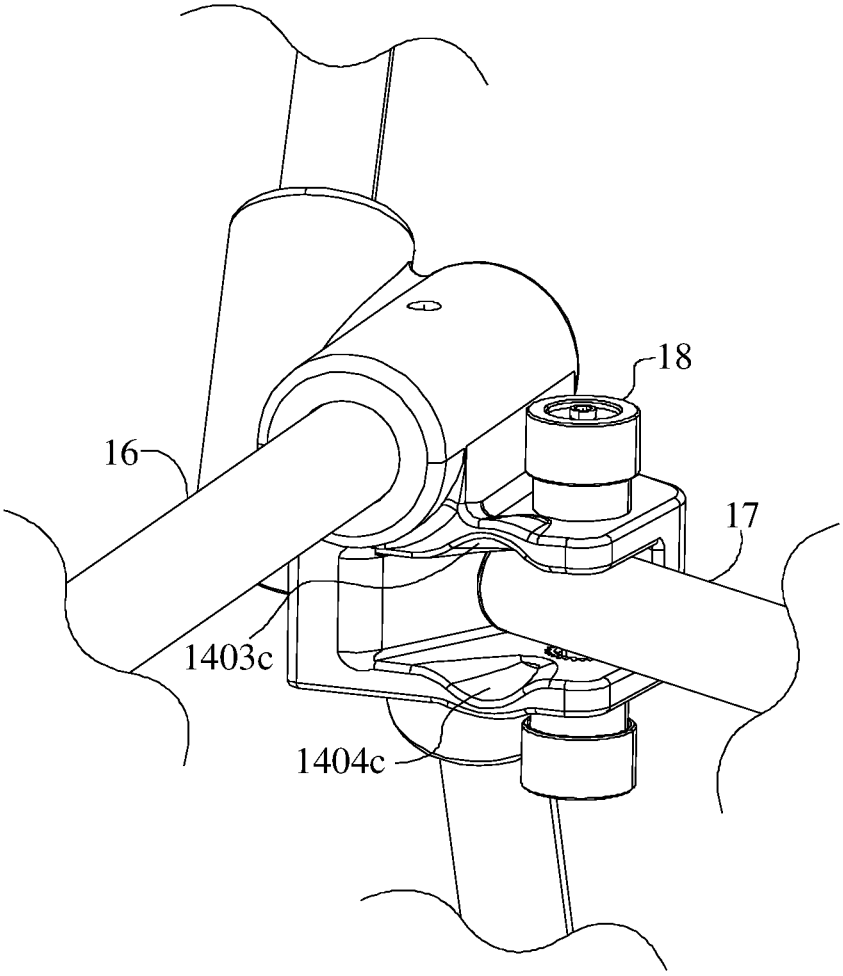
FIG. 20 is a schematic structural diagram after a front connecting rod is clamped with a right front supporting seat in a third embodiment.
Figure 22:
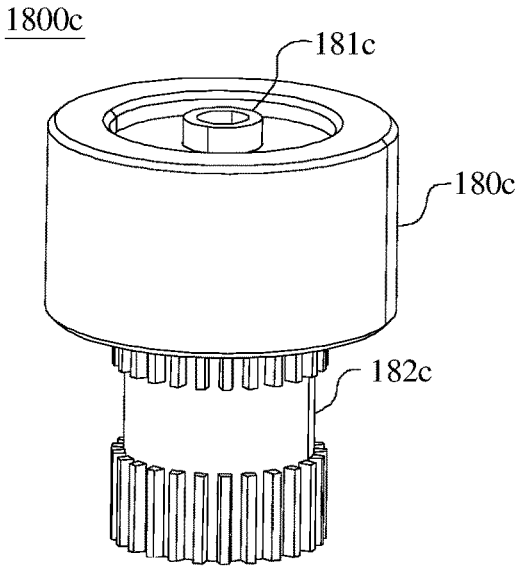
FIG. 22 is a schematic structural diagram of an unlocking unit in the folding chair bracket shown in FIG. 16.

As shown in FIG. 18, FIG. 21 and FIG. 22, the folding locking assembly 18 further includes unlocking units 1800*c*, the first positioning hole 1401*c* and the second positioning hole 1402*c* are each provided with one unlocking unit 1800*c*, and the unlocking units 1800*c* may extrude the first positioning column 1701*c* located in the first positioning hole 1401*c* and the second positioning column 1702*c* located in the second positioning hole 1402*c* in a case of external force application, such that the first positioning column 1701*c* is separated from the first positioning hole 1401*c*, and the second positioning column 1702*c* is separated from the second positioning hole 1402*c*.

As shown in the figures, each unlocking unit 1800*c* includes a cylindrical limiting piece 182*c*, a pin 181*c* and a key cap 180*c*, each limiting piece 182*c* is arranged corresponding to the insides of the first positioning hole 1401*c* and the second positioning hole 1402*c* and is internally provided with a first cavity 1820*c* and a second cavity 1821*c* with an inner diameter smaller than an inner diameter of the first cavity 1820*c*, the pin 181*c* penetrates through the limiting piece 182*c*, and a limiting part 1810*c* with an outer diameter smaller than the inner diameter of the first cavity 1820*c* but greater than the inner diameter of the second cavity 1821*c* is formed at a tail end of the pin 181*c*, so that the limiting part 1810*c* may move within the first cavity 1820*c* but cannot move within the second cavity 1821*c*. Preferably, exteriors of the limiting pieces 182*c* may be made into shapes adaptive to interiors of the first positioning hole 1401*c* and the second positioning hole 1402*c*, such as a toothed gear shape, and the key caps 180*c* are connected to start ends of the pins 181*c*.

Through the matching of the limiting pieces 182*c* and the pins 181*c*, the pins 181*c* may move up and down within a certain range along the axis of the first positioning hole 1401*c* and the second positioning hole 1402*c*. When the first positioning column 1701*c* and the second positioning column 1702*c* are inserted into the first positioning hole 1401*c* and the second positioning hole 1402*c*, the first positioning column 1701*c* and the second positioning column 1702*c* push the pins 181*c* located in the first positioning hole 1401*c* and the second positioning hole 1402*c* outwards, so that the pins 181*c* move towards an insertion direction. When the folding chair 1 needs to be unlocked, the key caps 180*c* on the upper and lower sides are pressed to drive the two pins 181*c* to extrude the first positioning column 1701*c* and the second positioning column 1702*c* inwards, so that the first positioning column 1701*c* and the second positioning column 1702*c* are separated from the first positioning hole 1401*c* and the second positioning hole 1402*c* to complete unlocking.

Based on the above design, when the right end of the front connecting rod 17 is rotated into the connecting recess 140, the first positioning column 1701*c* and the second positioning column 1702*c* at the right end of the front connecting rod 17 are correspondingly rotated to the first positioning hole 1401*c* and the second positioning hole 1402*c*, and the first positioning column 1701*c* and the second positioning column 1702*c* are popped up and inserted into the first positioning hole 1401*c* and the second positioning hole 1402*c* to achieve self-locking. At the moment, the front connecting rod 17 is fixed to the right front supporting seat 14, and a folding chair is unfolded and fixed. When the unlocking units 1800*c* on the upper and lower sides are pressed, the first positioning column 1701*c* and the second positioning column 1702*c* are extruded to be separated from the first positioning hole 1401*c* and the second positioning hole 1402*c* to achieve unlocking, so that the front connecting rod 17 may rotate around the left front supporting seat 13 horizontally, to achieve folding of the folding chair.

Figure 16:
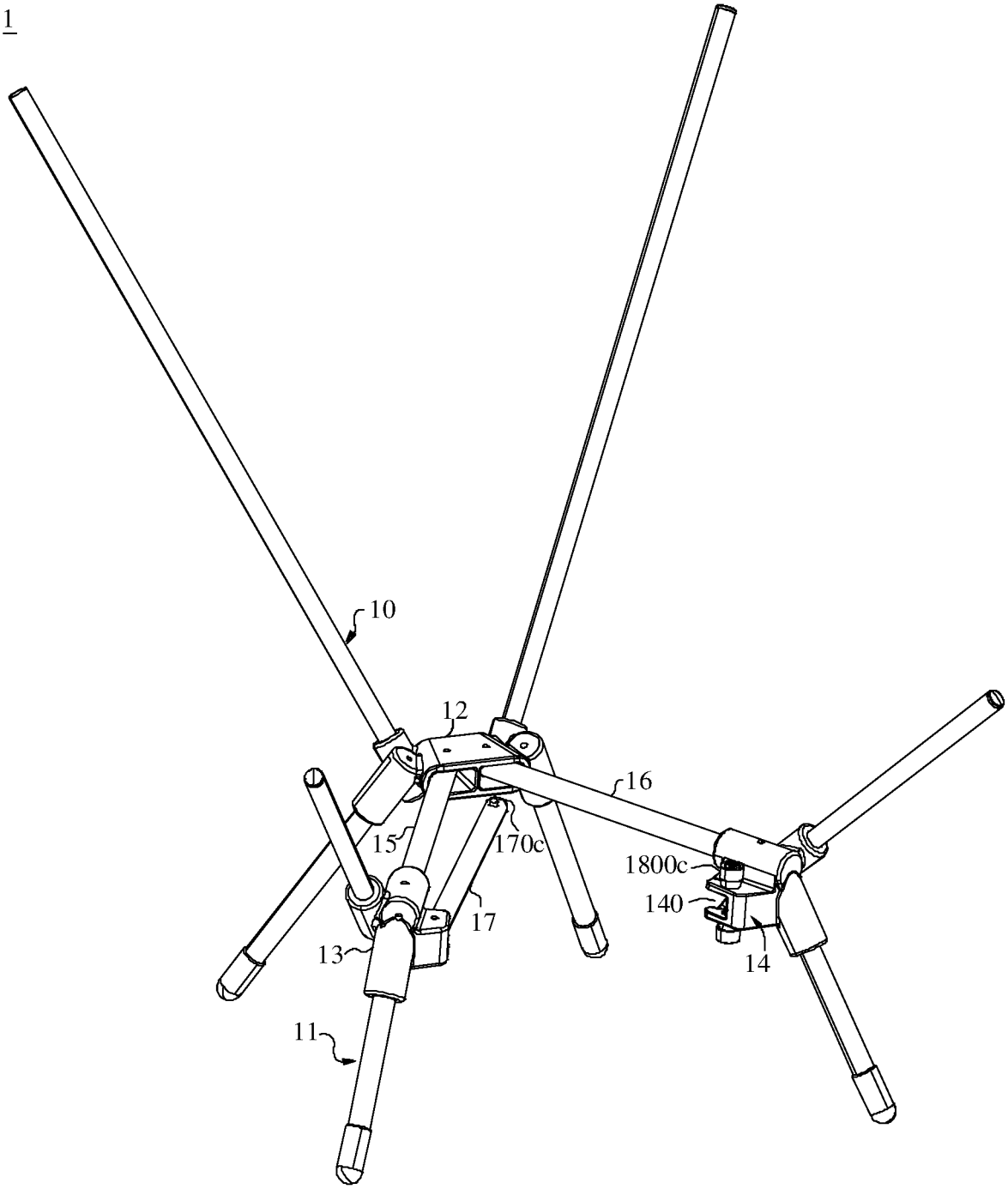
FIG. 16 is a schematic structural diagram of a third embodiment of a folding chair bracket of the present disclosure.
Figure 23:
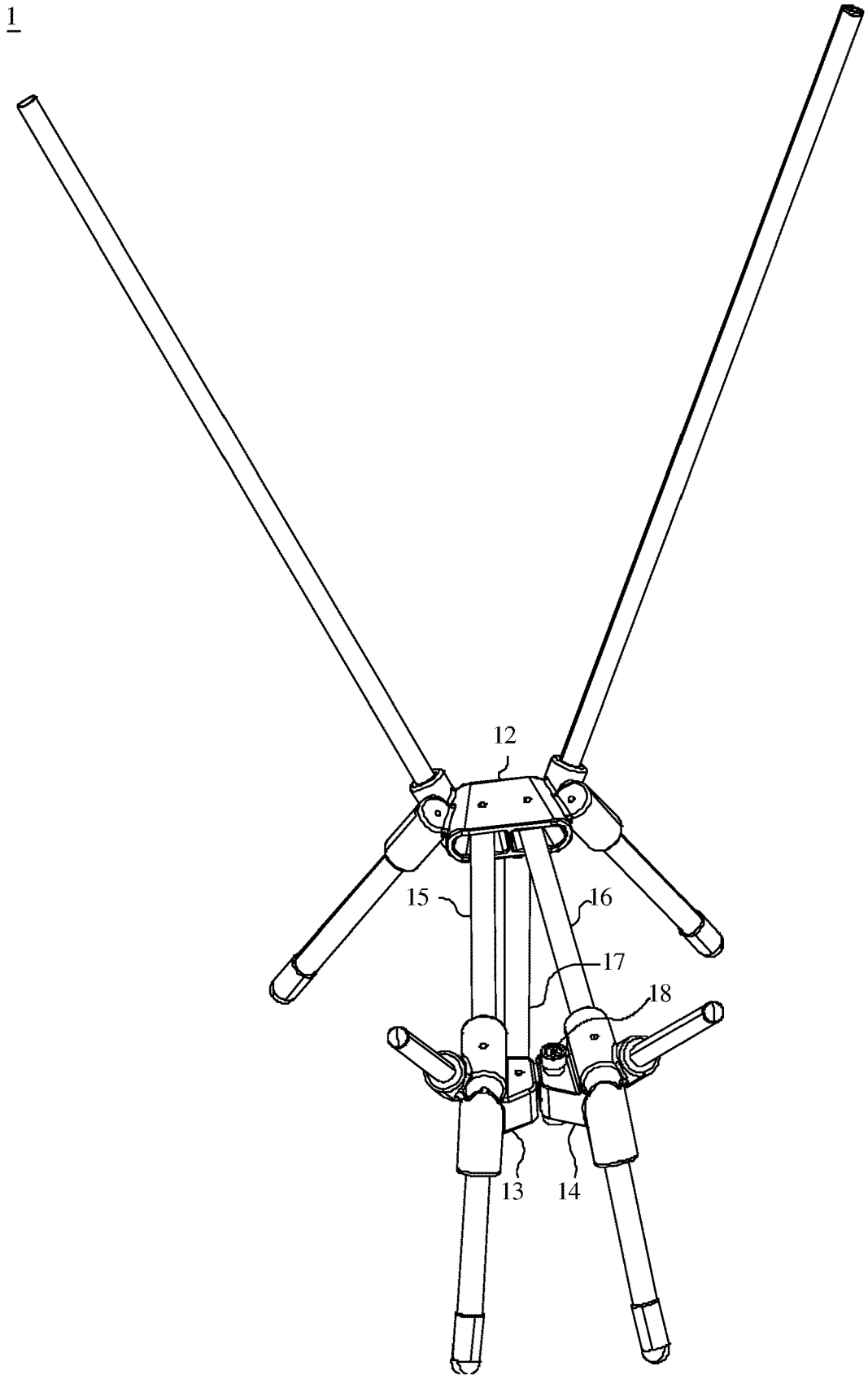
FIG. 23 is a schematic diagram of the folding chair bracket shown in FIG. 16 in a fully folded state.

With reference to FIG. 16 and FIG. 23, a use process of the folding chair bracket 1 in this embodiment is specifically described. When the folding chair bracket 1 is unfolded, firstly, the left connecting rod 15 is rotated leftwards to an extreme position, the right connecting rod 16 is rotated rightwards to an extreme position, and at the moment, the folding chair bracket 1 is as shown in FIG. 16. Then, the front connecting rod 17 is pulled to rotate around the third assembly shaft 1301 to rotate to a position in front of the connecting recess 140 of the right front supporting seat 14, at the moment, the first positioning column 1701*c* and the second positioning column 1702*c* have not been compressed, and the front connecting rod 17 is further rotated, so that the first guiding surface 1403*c* gradually extrudes the first positioning column 1701*c* downwards, and the second guiding surface 1404*c* gradually extrudes the second positioning column 1702*c* upwards until the first positioning column 1701*c* and the second positioning column 1702*c* are compressed into the front connecting rod 17. Finally, the front connecting rod 17 continues to be pulled until the first positioning column 1701*c* and the second positioning column 1702*c* are automatically popped up under the elastic action and inserted into the first positioning hole 1401*c* and the second positioning hole 1402*c*, the pins 181*c* in the first positioning hole 1401*c* and the second positioning hole 1402*c* are extruded by the first positioning column 1701*c* and the second positioning column 1702*c* to be pushed out, to drive the key caps 180*c* to be pushed out, the front connecting rod 17 and the right front supporting seat 14 are locked, and the folding chair bracket 1 is fully unfolded. When the folding chair bracket 1 is stored, firstly, the upper and lower key caps 180*c* of the right front supporting seat 14 are pressed, at the moment, the pins 181*c* are pushed to move into the first positioning hole 1401*c* and the second positioning hole 1402*c* by pressing the key caps 180*c*, and under the extrusion of the pins 181*c*, the first positioning column 1701*c* and the second positioning column 1702*c* are correspondingly retracted into the front connecting rod 17 until they are separated from the first positioning hole 1401*c* and the second positioning hole 1402*c*. Then, the front connecting rod 17 is operated to rotate to the rear supporting seat 12, the right end of the front connecting rod 17 is rotated to the rear supporting seat 12, then the left connecting rod 15 is rotated rightwards to an extreme position, and the right connecting rod 16 is rotated leftwards to an extreme position, to complete the storage and folding of the folding chair bracket 1. Finally, the supporting rods 10 and the supporting legs 11 may further be detached.

Referring to FIG. 24 to FIG. 28, FIG. 24 to FIG. 28 show a fourth embodiment of a folding chair bracket 1 of the present disclosure. The difference between this embodiment and the first embodiment lies in specific structures of the locking piece and the pushing piece in the folding locking assembly 18 and its connection relationship with the right front supporting seat 14, and other structures are the same or similar. In this embodiment, a locking piece 180*d* includes a fixing cylinder 1800*d* and a fixing pin 1801*d* located in the fixing cylinder 1800*d*, the fixing cylinder 1800*d* is fixed to a top of the right front supporting seat 14, and one side of the fixing cylinder 1800*d* is provided with a groove body 8001*d*. A pushing piece 181*d* includes a key 1811*d* and a lifting piece 1812*d*, the lifting piece 1812*d* includes a pushing rod 8121*d* and a lift rod 8122*d* formed by bending downwards from an upper end part of one side of the pushing rod 8121*d*, an upper end surface of the other side of the pushing rod 8121*d* is an inclined surface, the lift rod 8122*d* penetrates through the fixing pin 1801*d* and is located in the groove body 8001*d*, the pushing rod 8121*d* is located outside the fixing cylinder 1800*d*, the key 1811*d* is located above the fixing pin 1801*d*, an elastic piece 182*d* is located in the key 1811*d*, with one end connected with the key 1811*d* and the other end connected with the fixing pin 1801*d*, a position in the key 1811*d* corresponding to the pushing rod 8121*d* is provided with a push plate 8111*d*, and a lower end part of the push plate 8111*d* is correspondingly arranged as an inclined surface, thereby being matched with the pushing rod 8121*d* when moving downwards under an external force action to enable the lift rod 8122*d* to move upwards in the groove body 8001*d*, to drive the fixing pin 1801*d* to move upwards. Based on the above design, through the matching of the inclined surface of the push plate 8111*d* in the key 1811*d* and the inclined surface of the pushing rod 8121*d*, in a process of downward movement of the key 1811*d*, the pushing rod 8121*d* may move towards a direction close to the fixing pin 1801*d*, because the fixing pin 1801*d* is located in the fixing cylinder 1800*d*, the lift rod 8122*d* is fixed onto the fixing pin 1801*d* in a penetrating mode, and the lift rod 8122*d* drives the fixing pin 1801*d* to move upwards, so that the fixing pin 1801*d* is removed from a penetrating hole.

Figure 26:
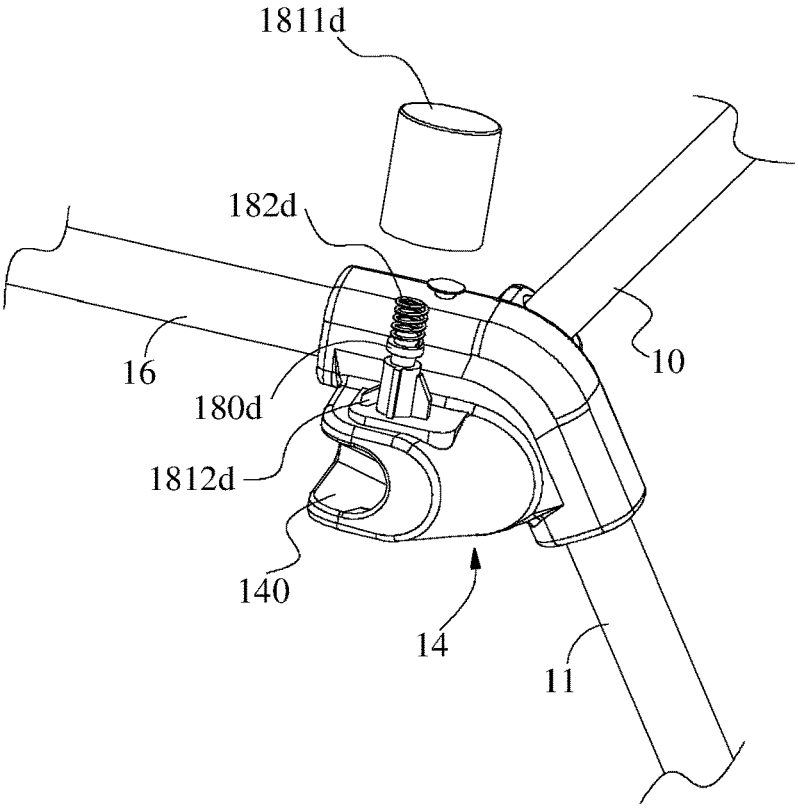
FIG. 26 is a partial schematic exploded view of a right front supporting seat in the folding chair bracket shown in FIG. 24.
Figure 27:
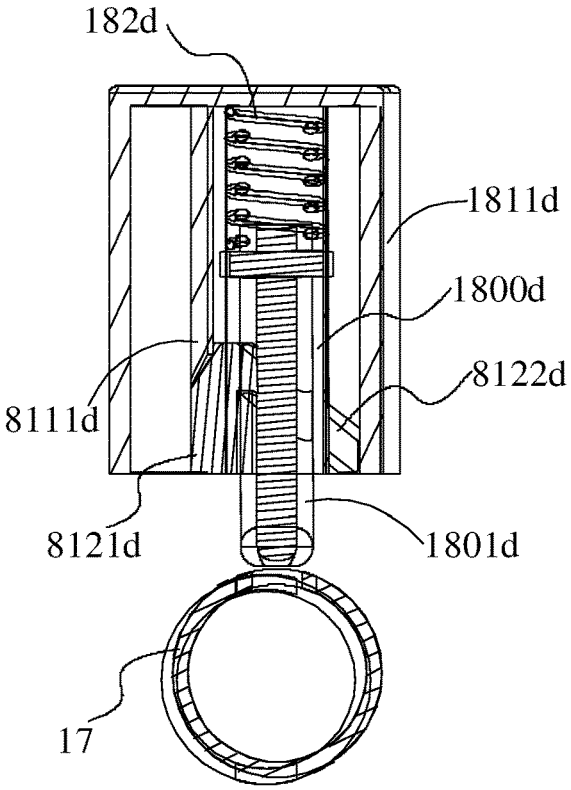
FIG. 27 is a schematic cross-sectional view of matching of a folding locking assembly with a front connecting rod in the folding chair bracket shown in FIG. 24.
Figure 28:
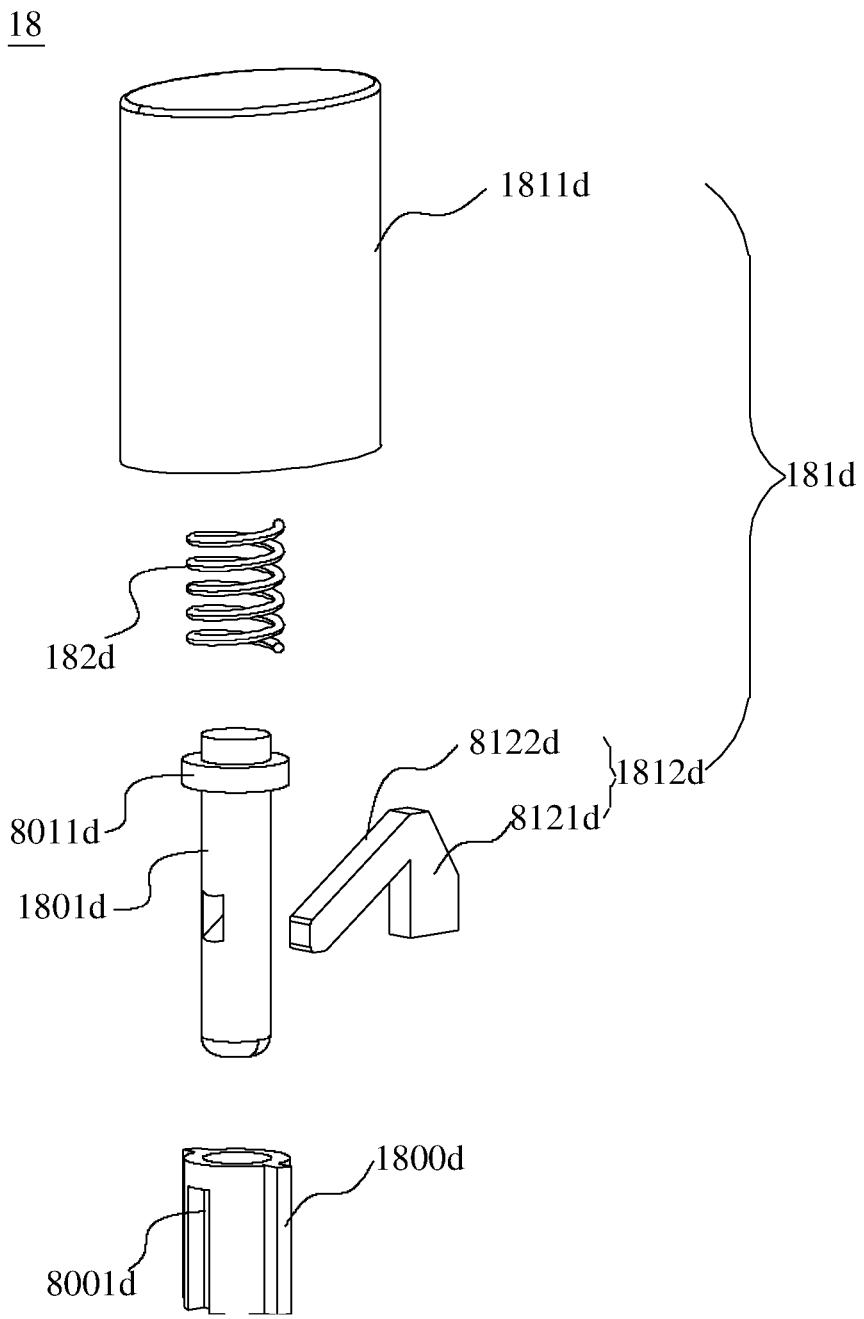
FIG. 28 is a schematic exploded view of the folding locking assembly in the folding chair bracket shown in FIG. 24.

Continuing to refer to FIG. 26 to FIG. 28, further, in this embodiment, a protruding ring 8011*d* which protrudes outwards is formed on an upper part of the fixing pin 1801*d*, and the protruding ring 8011*d* is located above the fixing cylinder 1800*d* to limit a distance of downward movement of the fixing pin 1801*d*.

Figure 24:
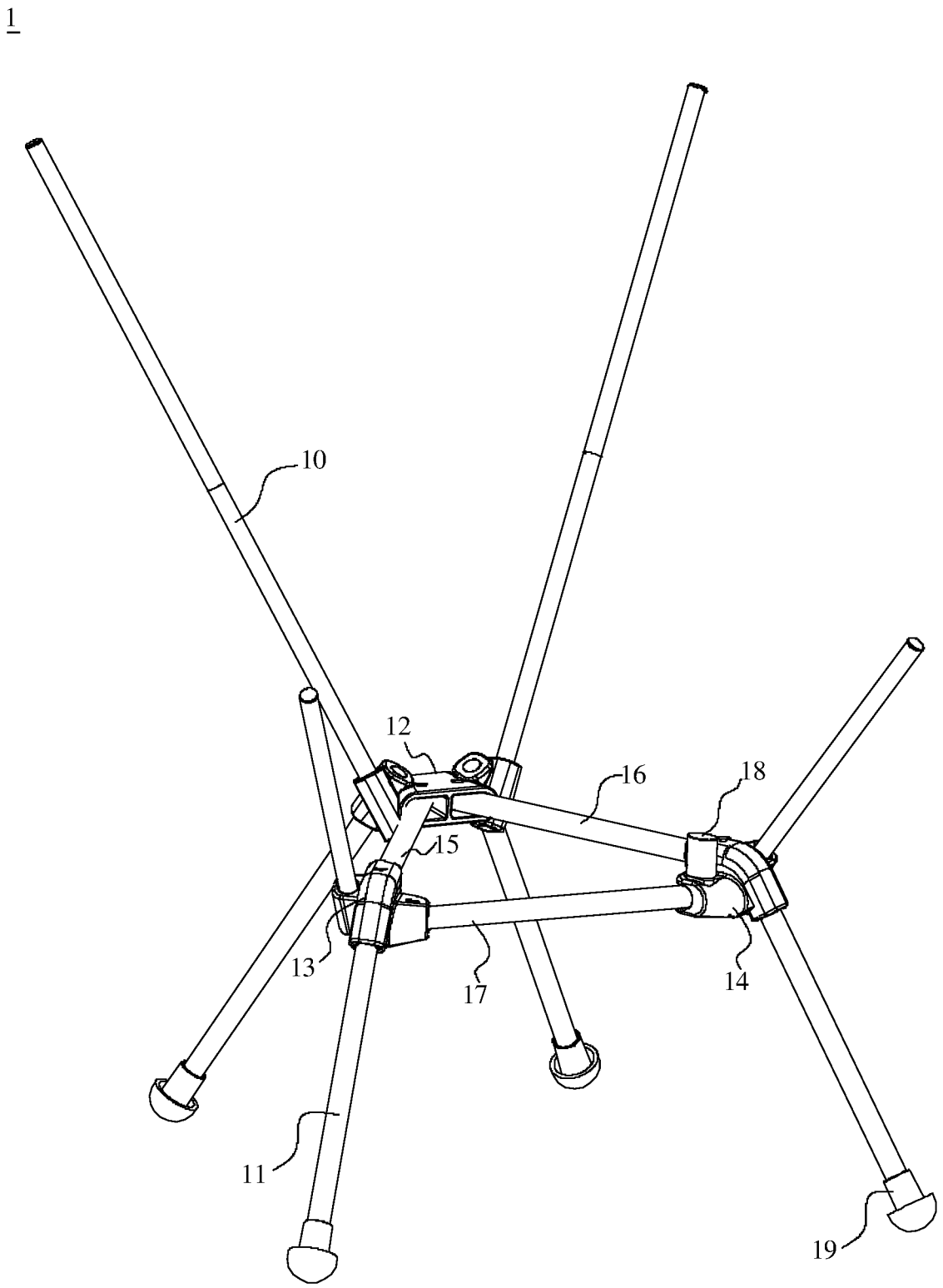
FIG. 24 is a schematic structural diagram of a fourth embodiment of a folding chair bracket of the present disclosure.
Figure 25:
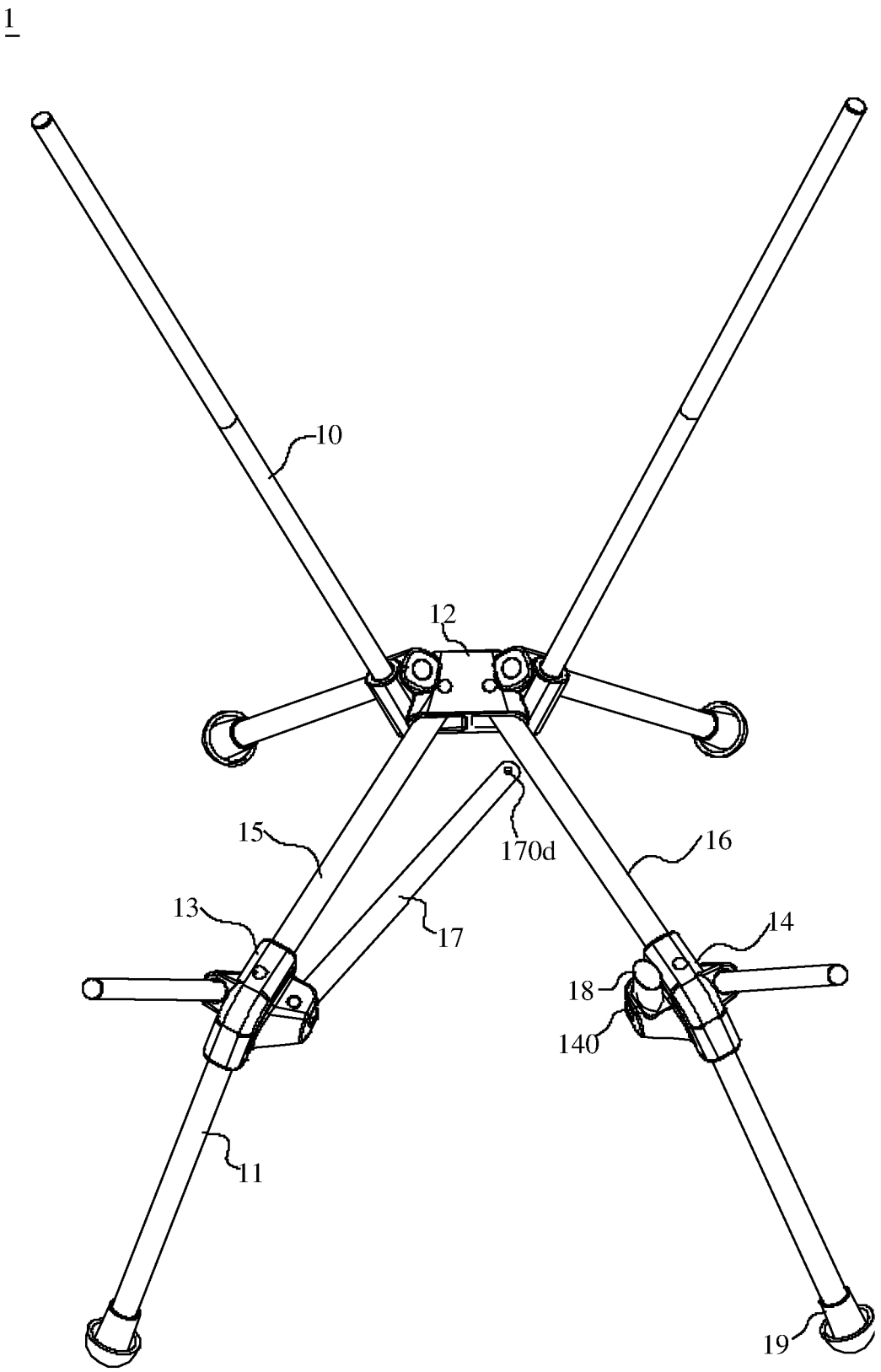
FIG. 25 is a schematic diagram of an unfolding process of the folding chair bracket shown in FIG. 24.

With reference to FIG. 24 and FIG. 25, a use process of the folding chair bracket 1 in this embodiment is specifically described. During unfolding, firstly, the left connecting rod 15 is rotated leftwards to an extreme position, the right connecting rod 16 is rotated rightwards to an extreme position, and at the moment, the folding chair bracket 1 is as shown in FIG. 10. Then, the front connecting rod 17 is pulled to rotate around the third assembly shaft 1301, at the same time, the key 1811*d* is pushed, so that the fixing pin 1801*d* in the locking piece 180*d* moves upwards, after one end which is not connected with the third assembly shaft 1301 moves into the connecting recess 140 of the right front supporting seat 14, the key 1811*d* is released, the fixing pin 1801*d* in the locking piece 180*d* moves downwards under the elastic action of the elastic piece 182*d*, to be quickly clamped into the penetrating hole 170*a* of the front connecting rod 17, so that the front connecting rod 17 is locked into the connecting recess 140, the folding chair bracket 1 is as shown in FIG. 9, and unfolding and fixing are completed. When the folding chair bracket 1 is folded and stored, firstly, the key 1811*d* arranged on the upper part of the right front supporting seat 14 is pushed, through the matching of the inclined surface of the push plate 8111*d* in the key 1811*d* and the inclined surface of the pushing rod 8121*d*, in the process of downward movement of the key 1811*d*, the pushing rod 8121*d* moves towards the direction close to the fixing pin 1801*d*, while the fixing pin 1801*d* is located in the fixing cylinder 1800*d*, so that the lift rod 8122*d* which is fixed to the fixing pin 1801*d* in a penetrating mode may move upwards in the groove body 8001*d*, to drive the fixing pin 1801*d* to move upwards. Therefore, the fixing pin 1801*d* is removed from the penetrating hole 170*d*. Then, the front connecting rod 17 is operated to rotate towards a direction close to the rear supporting seat 12, to be separated from the right front supporting seat 14 and move to a position below the rear supporting seat 12, then the left connecting rod 15 is rotated rightwards to an extreme position, the right connecting rod 16 is rotated leftwards to an extreme position, and storage and folding of the folding chair bracket 1 are completed. Further, the supporting rods 10 and the supporting legs 11 may further be detached, so that the folding chair bracket 1 is more compact during folding and storage, and is easy to carry.

Figure 29:
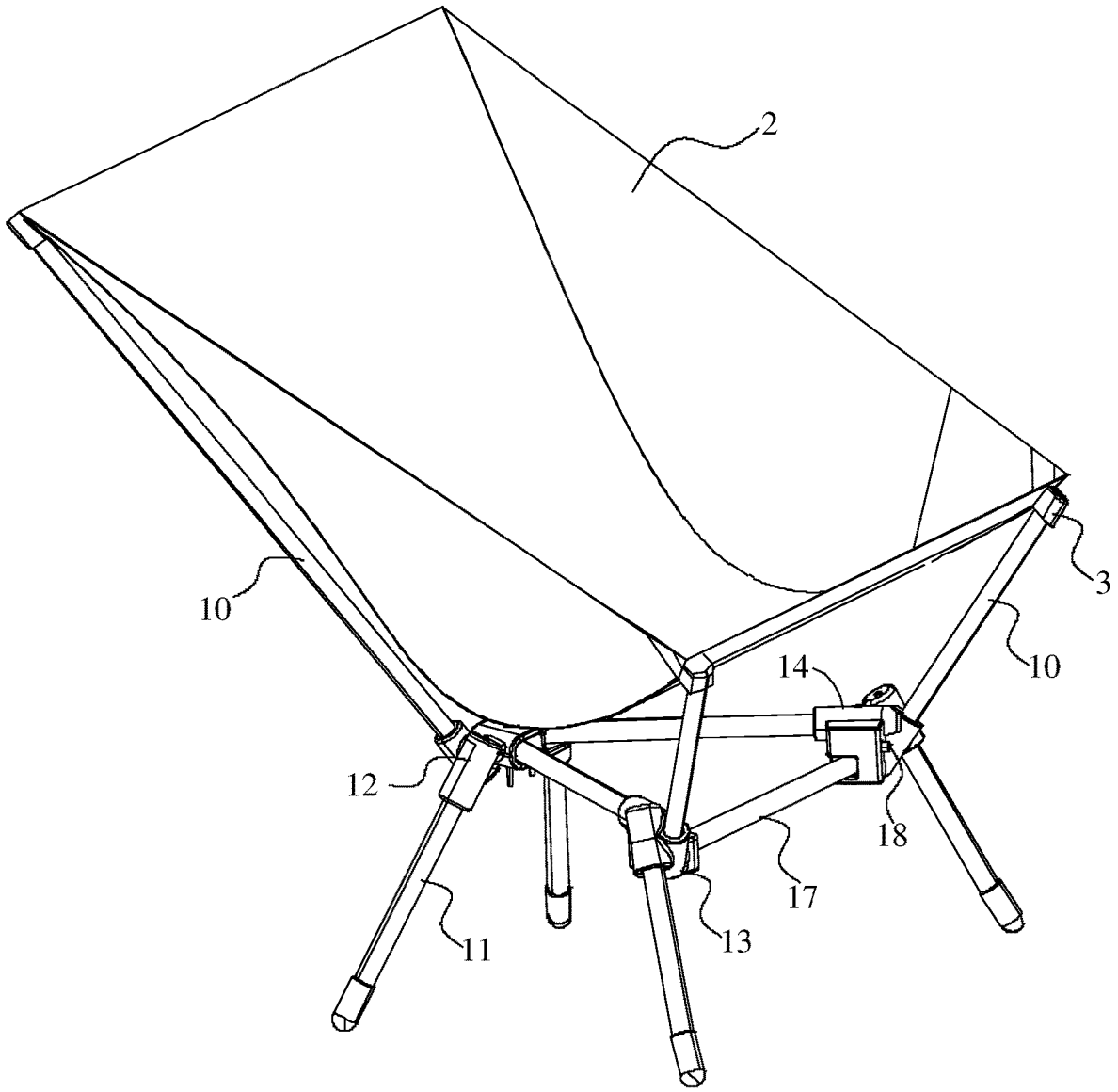
FIG. 29 is a schematic structural diagram of a specific embodiment of a folding chair of the present disclosure.

Referring to FIG. 29, FIG. 29 is a schematic structural diagram of a specific embodiment of a folding chair of the present disclosure. With reference to FIG. 1, in the embodiment shown in the figure, the folding chair includes a folding chair bracket 1 described in the above first embodiment and a flexible seat surface 2 connected with an upper part of the folding chair bracket 1, connection sleeves 3 are connected with outer sides of four corners of the flexible seat surface 2 respectively, and the connection sleeves 3 are arranged on supporting rods 10 in a sleeving mode. The flexible seat surface 2 is made of a flexible and foldable material, and a concave space for a user to sit on is formed at a front side of the flexible seat surface 2. When the folding chair bracket 1 is unfolded, the flexible seat surface 2 is also fully unfolded under the action of the supporting rods 10, and because a rear supporting seat 12, a left front supporting seat 13 and a right front supporting seat 14 are connected through a left connecting rod 15, a right connecting rod 16 and a front connecting rod 17 to form a triangular structure, which is relatively stable when supported by supporting legs 11 after unfolding, when the folding chair bracket 1 is folded, the flexible seat surface 2 may also be folded. The folding chair of the present disclosure is simple in structure and convenient to unfold and fold, a folding locking assembly 18 for locking and unlocking the front connecting rod 17 is located on the right front supporting seat 14, and it is not prone to being accidentally touched during use, which avoids safety hazards of sudden folding of the folding chair caused by a situation that when people sit, a key is accidentally touched due to too large weight.

It may be understood that in some other embodiments, the folding chair may include a folding chair bracket 1 described in the above second embodiment/third embodiment/fourth embodiment and a flexible seat surface 2 connected with an upper part of the folding chair bracket 1, and a connection relationship between the flexible seat surface 2 and the folding chair bracket 1 in this embodiment is the same as that of the above embodiment, which will not be repeated here.

The above is only preferred embodiments of the present disclosure and does not limit the present disclosure in any form. Those skilled in the art may make various equivalent changes and improvements based on the above embodiments. Any equivalent variations or modifications made within the scope of the claims shall fall within the scope of protection of the present disclosure.

What is claimed is:

1. A folding chair bracket, comprising a rear supporting seat;

a left connecting rod, with a rear end hinged with the rear supporting seat to be capable of rotating in a horizontal direction;

a right connecting rod, with a rear end hinged with the rear supporting seat to be capable of rotating in the horizontal direction;

a left front supporting seat, connected to a front end of the left connecting rod;

a right front supporting seat, connected to a front end of the right connecting rod, one side of the right front supporting seat opposite to the left front supporting seat being provided with a connecting recess;

a front connecting rod, with a left end hinged to the left front supporting seat to be capable of rotating in the horizontal direction;

a folding locking assembly, arranged on the right front supporting seat and having a locked state and an unlocked state, wherein in the locked state, the folding locking assembly is capable of locking and fixing a right end of the front connecting rod into the connecting recess of the right front supporting seat, and in the unlocked state, the front connecting rod is capable of being removed from the connecting recess;

a plurality of supporting legs, correspondingly and detachably inserted to the rear supporting seat, the left front supporting seat and the right front supporting seat from bottoms; and a plurality of supporting rods, correspondingly and detachably inserted to the rear supporting seat, the left front supporting seat and the right front supporting seat from tops.

2. The folding chair bracket according to claim 1, wherein: the right end of the front connecting rod is provided with a penetrating hole, the folding locking assembly comprises a locking piece and a pushing piece, the locking piece is located in the connecting recess, the pushing piece is located on one side of the right front supporting seat, one end of the pushing piece penetrates through the right front supporting seat to be connected with the locking piece and is capable of pushing the locking piece to move up and down, such that the locking piece is clamped into the penetrating hole or removed from the penetrating hole.

3. The folding chair bracket according to claim 2, wherein: the folding locking assembly further comprises an elastic piece, the elastic piece is connected with the locking piece and an inner wall of the connecting recess, to compress when the pushing piece pushes the locking piece to move upwards and enable the locking piece to be quickly clamped into the penetrating hole under an elastic action.

4. The folding chair bracket according to claim 3, wherein: a protruding rod which protrudes outwards is formed on the locking piece, the pushing piece comprises a key and a push rod, the push rod comprises an abutting rod located below the protruding rod, a connecting rod connected with the key, and a transition rod connected between the abutting rod and the connecting rod, and a top surface of the transition rod is an inclined surface, such that the locking piece moves upwards when the key is pushed towards a direction close to the locking piece.

5. The folding chair bracket according to claim 4, wherein: a top of the right front supporting seat is inwardly recessed to form an accommodating cavity, the folding locking assembly further comprises a guiding piece, the guiding piece comprises a cover plate and a hollow guiding column formed by extending downwards from a middle of the cover plate, the cover plate is arranged at a top of the accommodating cavity in a covering mode, the guiding column penetrates through the accommodating cavity to be located in the connecting recess, a side wall of the guiding column is provided with a sliding groove, and the protruding rod is located in the sliding groove and is capable of moving in the sliding groove, to drive the locking piece to move up and down in the guiding column.

6. The folding chair bracket according to claim 5, wherein: a first protrusion part is formed on a cavity wall of the accommodating cavity, the guiding piece further comprises side plates which are formed on two sides of the cover plate, and a second protrusion part matched with the first protrusion part is formed on each side plate, to fix the guiding piece onto the right front supporting seat.

7. A folding chair, comprising the folding chair bracket according to claim 1 and a flexible seat surface connected with an upper part of the folding chair bracket, wherein a plurality of connection sleeves are arranged on the flexible seat surface, and the connection sleeves are arranged on supporting rods in a sleeving mode.

* * * * *